United States Patent [19]

Ishii et al.

[11] Patent Number: 5,040,259

[45] Date of Patent: Aug. 20, 1991

[54] FIRE HOSE WASHING APPARATUS

[75] Inventors: Keisuke Ishii; Hidetoshi Nakanishi, both of Tokyo, Japan

[73] Assignee: Showa Kiki Sangyo Kabushiki Kaisha, Tokyo, Japan

[21] Appl. No.: 409,775

[22] Filed: Sep. 20, 1989

[30] Foreign Application Priority Data

Sep. 22, 1988 [JP] Japan ..... 63-237988
Mar. 29, 1989 [JP] Japan ..... 1-77027

[51] Int. Cl.[5] ..... D06G 1/00; A46B 13/02

[52] U.S. Cl. ..... 15/40; 15/77; 15/88.3; 134/113

[58] Field of Search ..... 15/40, 77, 88.2, 88.3; 134/9, 113

[56] References Cited

FOREIGN PATENT DOCUMENTS 51-37462 10/1976 Japan .
52-12380 3/1977 Japan .

*Primary Examiner*—Edward L. Roberts
*Attorney, Agent, or Firm*—Kanesaka and Takeuchi

[57] ABSTRACT

Disclosed is a fire hose washing apparatus which comprises: a casing; a fire hose washing portion having rotary brushes and provided in the casing and along a path for feeding a fire hose; nozzles for supplying washing water to the washing portion; and first and second fire hose feeding devices disposed separately from each other for a predetermined distance at positions on the fire hose feeding path in the downstream side of the washing portion with respect to the fire hose feeding direction. The fire hose passed through the washing portion is pulled out by the first and second fire hose feeding devices. A plurality of sensors for detecting metal connectors of the fire hose is provided at different positions on the fire hose feeding path so that upon detection of a metal connector by one sensor, the fire hose is pulled out by the second fire hose feeding device while stopping the hose feeding by the first fire hose feeding device. Upon detection of a metal connector by another sensor, the fire hose is pulled out by the first fire hose feeding device while stopping the hose feeding by the second fire hose feeding device. Thus, the first and second fire hose feeding devices are alternatively and alternately operated upon detection of a metal connector so that the hose is cleaned continuously regardless of existence of the metal connectors.

13 Claims, 14 Drawing Sheets

FIRE HOSE WASHING APPARATUS

BACKGROUND OF THE INVENTION

1. Field of the Invention

The present invention relates to a hose washing apparatus suitable for washing a long-size hose such as a fire hose, and, more particularly, the invention relates to a hose washing apparatus in which serially connected hoses are continuously pulled out of a washing portion while avoiding metal fittings or connectors connecting the hoses at the time of hose washing.

2. Description of the Prior Art

A long-size hose, such as a fire hose, is used in a condition that a plurality of hoses each having a predetermined length is connected in series to one another through metal fittings or connectors atttached at opposite ends of each hose so as to form the long-size hose having a predetermined entire length. After use of such a long-size hose, on the contrary, the hoses must be always cleaned, dried and stored by winding or folding like a fan fold so that the hoses may be used rapidly with no trouble in the next use. To carry out washing of this type of hoses mechanically, at least one pair of rotary brush rolls supplied with washing water must be prepared to pass the hoses therebetween. In this case, each hose must be continuously pulled out of the rotary brush rolls. To pull out the hose, it is required to provide a pair of pressure rollers to pass the hose therebetween while the pressure rollers are rotated. From the point of view of carrying out the washing work efficiently, it is preferable to put the hoses in a state of one long-size hose. In order to make the hoses into one long-size hose, however, it is necessary to connect the hoses in series to one another through the metal connectors thereof. Each connection portion of the metal connectors is thicker than the hose portion. If the distance between the pressure rollers is established to be suitable for pulling of each hose portion, the metal connectors cannot pass between the pressure rollers. On the contrary, if the distance between the pressure rollers is established to be suitable for the thickness of the metal connectors, the hose cannot be pulled out.

One of such hose washing apparatus has been disclosed in Japanese Utility Model Publication No. 52-12380 published under the date of Mar. 18, 1977. The disclosed hose washing apparatus has a feed roll mounted on a machine frame for feeding a hose, a lower brush roll, an upper brush roll located above the lower brush roll and mounted on a rotary frame pivoted at its one end, and a pressing roller mounted on a lever pivoted to one side of the machine frame so that the pressing roller is forced to contact with the feed roller by the pivotal movement of the lever. The hose washing apparatus is designed so that when a water spraying nozzle or a metal connector is passed, the pressing roller is moved up by the manual operation of the lever and, at the same time, the rotary frame is moved up to widen the distance between the two brush rolls to thereby make it possible to move the water spraying nozzle or the metal connector with no trouble, and, on the contrary, the forcedly feeding of the hose and the continuous washing of the hose can be carried out by closing the distance between the two rolls.

In the case where the feed rolls and the brush rolls opposite to each other are opened manually, however, not only the metal connectors cannot be cleaned perfectly but also it is dangerous to manually operate at high-speed washing. Further, if the rolls are opened too early, the hose portion near the metal connector cannot be cleaned sufficiently.

On the other hand, a fire hose automatic washing apparatus has been disclosed in Japanese Patent Publication No. 51-37462 published under the date of Oct. 15, 1976. In this apparatus, at least one slat provided with a hook-like metal fitting for feeding a fire hose metal connector is disposed between a pair of parallel conveyers, and a pair of rotary brushes and a pair of feed rolls are vertically swingably provided in the upper and lower sides of a path for the slat. Also spraying devices for spraying washing solution and water are provided above the respective rotary brushes, and a clutch is provided on a driving shaft. In this automatic washing apparatus, several slats each having a hook-like metal fitting are provided between conveyers for the further washing the metal connectors of the hoses. However, the slats are unnecessary except when the metal connectors are fed while hooked by the slats, and increased cost is required correspondingly for the parts having no relation directly with the washing work. Further, since the conveyers provided with such slats projecting out of the feeding path are exposed, safety is not always perfect in operation.

SUMMARY OF THE INVENTION

It is therefore an object of the present invention to provide a fire hose washing apparatus by which a long-size hose with metal connectors can be cleaned speedily.

It is another object of the present invention to provide a fire hose washing apparatus in which hoses together with metal connectors can be fed and cleaned with no specific parts for feeding only the metal connectors.

It is a further object of the present invention to provide a fire hose washing apparatus in which safety during the operation thereof can be secured.

In order to attain the above objects, according to the present invention, the fire hose washing apparatus comprises: a fire hose washing means provided along a path for feeding a fire hose; a washing water supply means for supplying washing water to the washing means; first and second fire-hose feeding means disposed separately from each other through a predetermined distance at positions on the fire hose feeding path in the downstream side of the washing means with respect to the hose feeding direction; a plurality of metal connector detecting means for detecting metal connectors of the fire hose at different positions on the fire hose feeding path; and a feeding control means for alternately operating the first and second fire hose feeding means in accordance with the result of detection of the metal connector detecting means.

First, for example, a metal connector attached at one end of a lead hose is connected to a metal connector attached at one end of a fire hose to be cleaned, and a metal connector attached at the other end of the lead hose is set to a position between the first and second fire hose feeding means. Then, a hose portion of the lead hose is placed to lie on the hose feeding path between the washing means and one of the first and second fire hose feeding means near to the washing means. Then, a start button is pushed. The metal connector detecting means detects the metal connector located between the first and second fire hose feeding means, and in response to the result of detection, the feeding control means is operated so that the first fire hose feeding means far from the washing means is set in a stoppage state. On the other hand, the second fire hose feeding means near the washing means becomes in an operative state to feed the lead hose and pass the metal connector with no trouble. Cleaning is carried out while the lead hose and its metal connector pass through the washing means. When the metal connector attached at the forward end of the fire hose and connected to the metal connector attached at the backward end of the lead hose is detected by the metal connector detecting means at the upstream side of the second fire hose feeding means with respect to the hose feeding direction while washing is carried out, the feeding control means turns the second fire hose feeding means into a stoppage state and turns the first fire hose feeding means into an operative state so that the fire hose is fed by the first fire hose feeding means. When the metal connector comes to a position between the first and second fire hose feeding means, the second fire hose feeding means is turned into an operative state and, on the other hand, the first fire hose feeding means is turned into a stoppage state so that the metal connector is passed through the first fire hose feeding means. Hoses connected in series in the form of a long-sized hose are continuously cleaned by repeating the aforementioned operations alternately.

According to the present invention, a fire hose can be fed while avoiding the metal connector thereof, so that a long-sized fire hose provided with metal connectors can be cleaned speedily together with the metal connectors. Because the fire hose is clamped and fed by feeding rollers, no special parts for feeding only the metal connectors are required.

Other objects, features and effects of the present invention will become apparent in the following description of preferred embodiments when considered in connection with the accompanying drawings.

DESCRIPTION OF THE PREFERRED EMBODIMENTS

Figure 1:
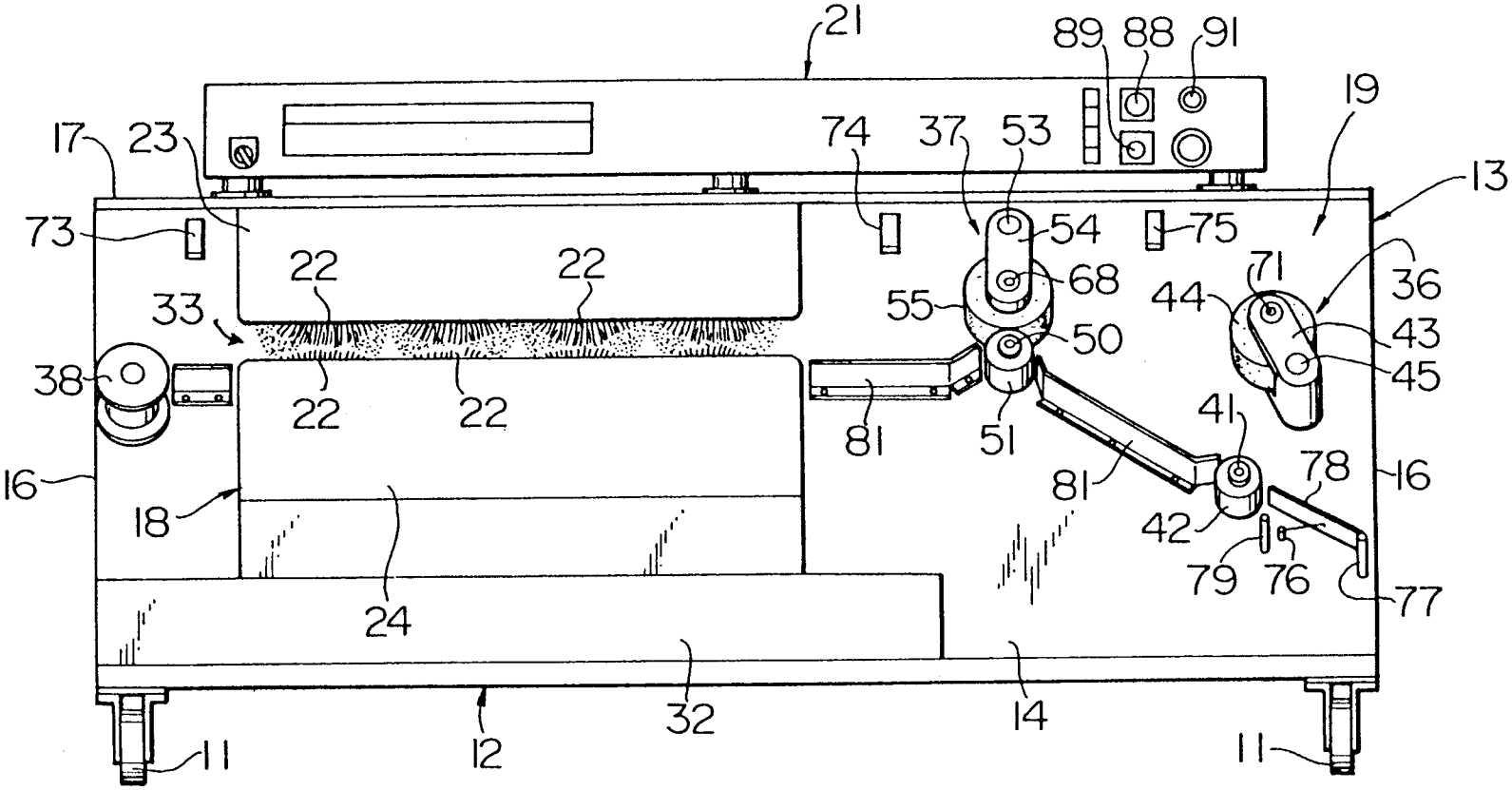
FIG. 1 is a front view of a fire hose washing apparatus as a first embodiment of the present invention.

Referring to the accompanying drawings, preferred embodiments of the present invention will be described in detail hereunder. In the drawings illustrating the embodiments, the same or equivalent items are referenced correspondingly, and double description or the same item will be omitted for the sake of simplification of the description.

Figure 2:
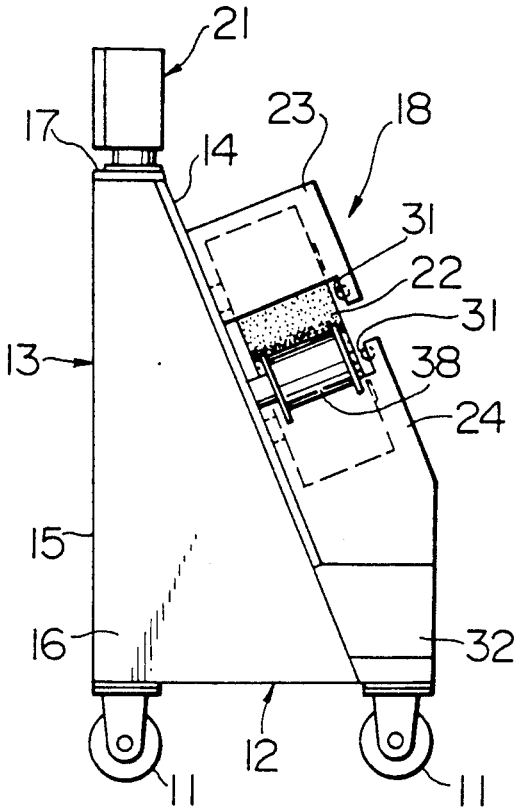
FIG. 2 is a left side view of the apparatus.

Referring now to FIGS. 1 through 13, description will be made about a first embodiment of the invention. As shown in FIGS. 1 and 2, the fire hose washing apparatus according to the invention is provided with a truck 12 having moving wheels 11 provided at the bottom thereof and a housing 13 mounted on the truck 12. The housing 13 is constituted by a front panel 14 sloping downward to the front of the apparatus, a rear panel 15 which is substantially vertical, side panels 16 at both sides of the apparatus, and an upper panel 17. A fire hose washing portion 18 and a fire hose feeding portion 19 are provided on the front panel 14. A control portion or control box 21 is provided on the upper panel 17.

Figure 3:
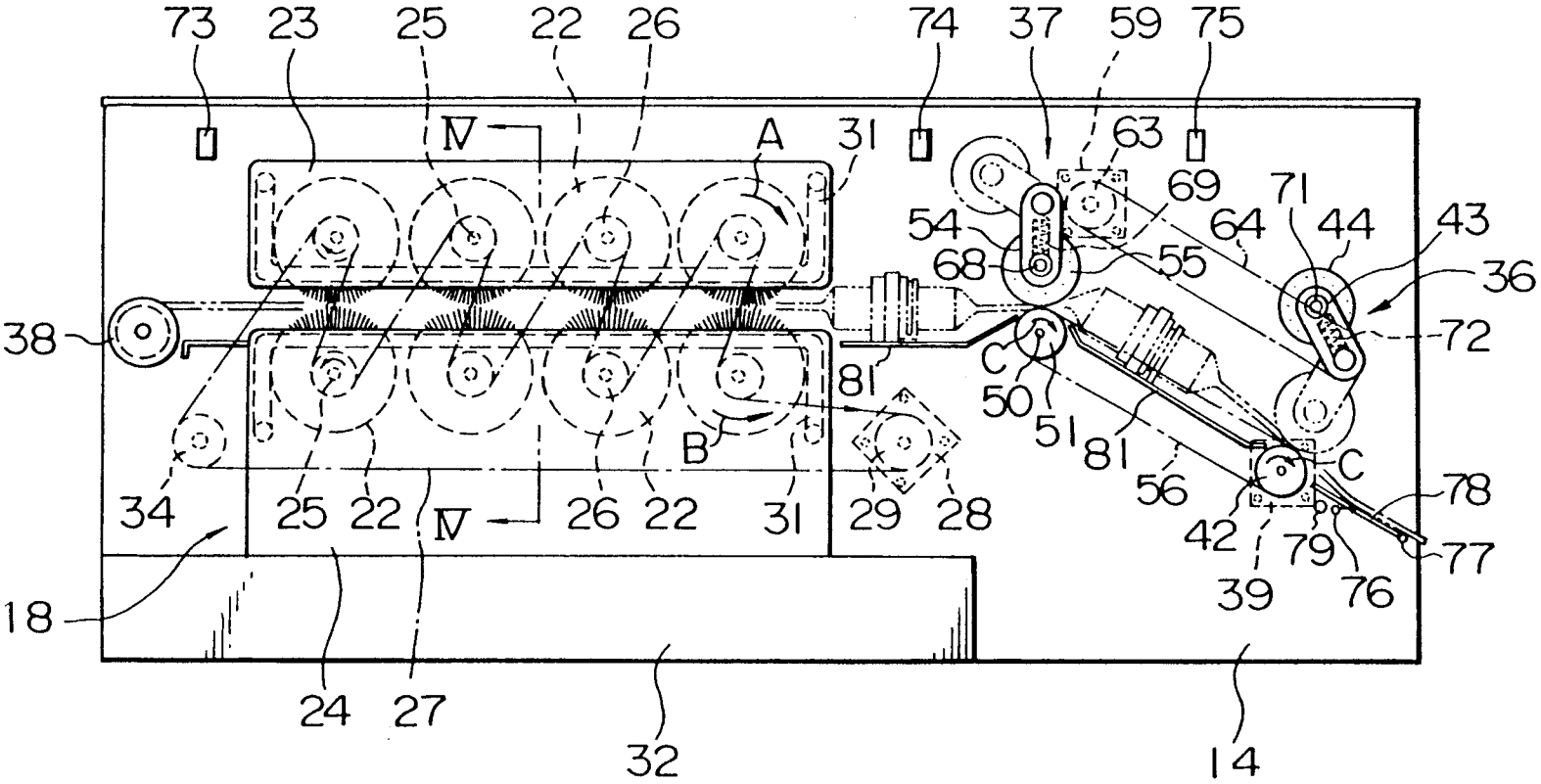
FIG. 3 is a front view of a front panel of the apparatus.

As shown in FIGS. 1 through 4, the fire hose washing portion 18 has four pairs of washing brushes 22 respectively located at upper and lower sides so as to face opposite to each other. The washing brushes 22 located at the upper side are covered with an upper brush cover 23, and the washing brushes 22 located at the lower side are covered with a lower brush cover 24. The brush covers 23 and 24 are arranged so as to have a predetermined distance between the lower end of the upper brush cover 23 and the upper end of the lower brush cover 24. The washing brushes 22 are mounted respectively on outwardly projected portions of rotary shafts 25 which are rotatably provided on the front panel 14. The rotary shafts 25 are projected also into the housing 13 and provided with sprockets 26 on inwardly projected end portions thereof. An endless chain 27 is entrained over the sprockets 26 in a manner as shown in FIG. 3. The endless chain 27 is entrained further over a sprocket 29 of a brush driving motor 28 provided in the housing 13, so that the endless chain 27 can be moved in a predetermined direction by the brush driving motor 28. Cleaning water supply pipes 31 are provided respectively in the rear surface of the upper brush cover 23 and in the rear surface of the lower brush cover 24 so as to supply washing water to the washing brushes 22, preferably to contacting portions between the opposite washing brushes 22. Further, a washing water receiver 32 is provided under the lower brush cover 24.

The pairs of washing brushes 22 have hairs with a length enough to make contact with each other at the ends of the opposite brushes. The contacting portions of the hairs form a part of a fire hose feeding path 33. The endless chain 27 is entrained, as described above, over the sprocket 29 of the driving motor 28 and the sprockets 26 of the washing brushes 22 so as to make the four upper-side located washing brushes 22 rotate clockwise (in the direction of the arrow A) and so as to make the four lower-side located washing brushes 22 rotate counterclockwise (in the direction of the arrow B), and entrained further over a sprocket 34 so that the tension of the endless chain 27 can be adjusted by the sprocket 34, as shown in FIG. 3.

Figure 4:
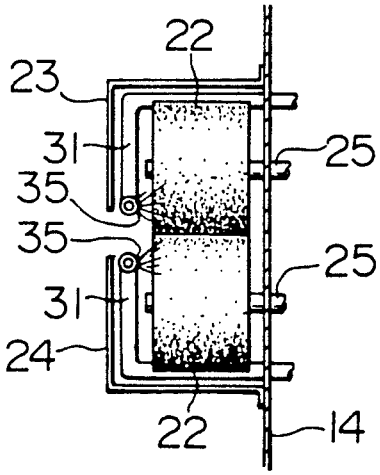
FIG. 4 is a sectional view taken along the line IV—IV in FIG. 3.

Pipes 31 for supplying washing water to the contacting portions of the washing brushes 22 extend from the rear of the front panel 14 to the front thereof as shown in FIG. 4 which is a sectional view taken along the line IV—IV in FIG. 3, so that the pipes 31 can eject washing water toward the contacting portions of the washing brushes 22, that is, toward the fire hose feeding path, through nozzles 35 which are provided on the pipes 31 at positions opposite to the washing brushes 22.

As shown in FIG. 1, the fire hose feeding portion 19 has first and second fire hose feeding means 36 and 37 provided on an outlet side of the fire hose washing portion 18, and a guide roller 38 provided on an inlet side of the same.

Figure 5:
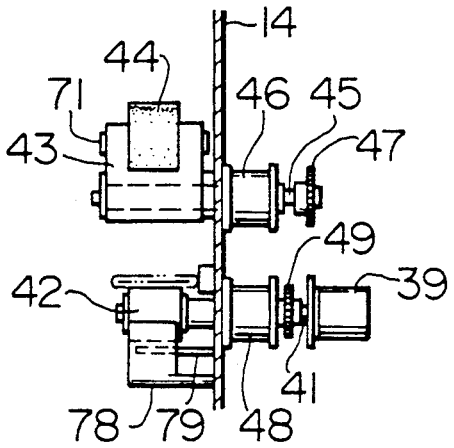
FIG. 5 is a side view showing a part of a first fire hose feeding means of the apparatus.

As shown also in FIG. 5, the first fire hose feeding means 36 has a capstan driving motor 39 supported at the rear side of the front panel 14 by a bracket or the like not shown, a capstan 42 supported at the front side of the front panel 14 by a driving shaft 41 of the motor 39, and a pinch roller 44 rotatably supported at one end of a supporting arm 43. The supporting arm 43 is rotatably supported at the rear side of the front panel 14 by a bearing 46 through a rotary shaft 45 of the supporting arm 43. A sprocket 47 is mounted on the rotary shaft 45, and another sprocket 49 is mounted on the driving shaft 41 of the capstan driving motor 37 through a bearing 48.

Figure 6:
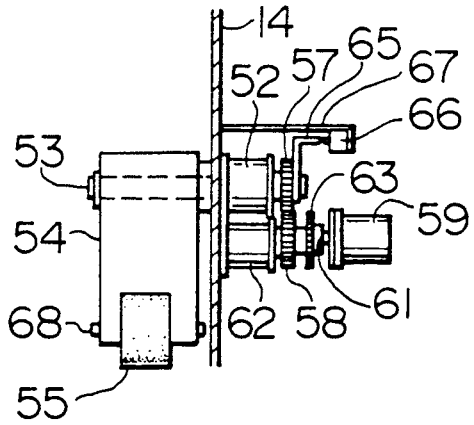
FIG. 6 is a partly sectional view showing a mechanism for driving a supporting arm in a second fire hose feeding means of the apparatus.

The second fire hose feeding means 37 has a capstan 51 supported at the front side of the front panel 14 by a rotary shaft 50 rotatably supported at the rear side of the front panel by a bearing (not shown), a rotary shaft 53 rotatably supported at the rear side of the front panel 14 by a bearing 52 as shown in FIG. 6, a supporting arm 54 supported at the front side of the front panel 14 by the rotary shaft 53, and a pinch roller 55 rotatably supported at one end of the supporting arm 54.

A sprocket (not shown) is mounted, at the rear side of the front panel 14, on the rotary shaft 50 of the capstan 51, and a capstan driving endless chain 56 is entrained over the above-mentioned sprocket (not shown) and the sprocket 49 so that the two capstans can rotate in synchronism with each other in the fire hose feeding direction, that is, clockwise (in the direction of the arrow C) as shown in FIG. 3.

As shown in FIG. 6, a follower or driven gear 57 is mounted on the rotary shaft 53 of the supporting arm 54, and a driving gear 58 engaged with the gear 57 is mounted on a driving shaft 61 of a motor 59 for driving the supporting arm 54. The driving motor 59 is a brake-including motor so that the driving shaft 61 can be kept in a stop position when stopped. The driving motor 59 is supported at the rear side of the front panel 14 by a bracket (or the like) not shown. The driving shaft 61 is rotatably supported at the rear side of the front panel 14 by a bearing 62. A sprocket 63 as well as the gear 58 is mounted on the driving shaft 61. An endless chain 64 for driving the supporting arm 43 is entrained over between the sprocket 63 and the sprocket 47 mounted on the rotary shaft 45 of the first fire hose feeding means 36. The rotary shaft 53 is provided with a dog or carrier 65 for detecting the rotation angle of the shaft. Specifically, the dog 65 is provided to detect the fact that the rotary shaft 53 rotates at 120 degrees. That is, the dog 65 is constructed so that the top end of the dog 65 is brought into contact with a limit switch 66 when the rotary shaft 53 rotates at 120 degrees from the starting position thereof. The limit switch 66 is attached to one end of a supporting member 67, another end of which is attached to the front panel 14.

Figure 7:
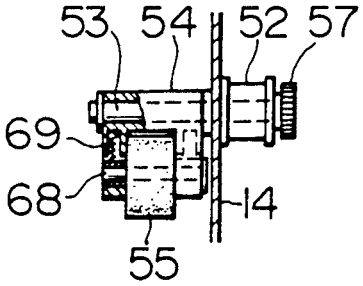
FIG. 7 is a partly sectional view showing a mechanism for supporting a pinch roller of the supporting arm depicted in FIG. 6.

As shown in a partly side view of FIG. 7, a structure for supporting the pinch roller 55 of the supporting arm 54 is such that a shaft 68 for supporting the pinch roller 55 is elastically urged by a coil spring 69 in the direction to come away from the rotary shaft 53 to thereby keep the moving stroke of the shaft 68 for the thickness of the fire hose. Similarly to a structure for supporting the pinch roller 55, a structure for supporting the pinch roller 44 of the supporting arm 43 is such that a shaft 71 thereof is elastically urged by a coil spring 72 so as to come away from the rotary shaft 45 to thereby keep the moving stroke for the thickness of the fire hose.

A first sensor or hose detecting sensor 73 is provided above the guide roller 38 disposed at the left side in FIG. 3 and near the upper brush cover 23. A second sensor or a first metal detecting device 74 is provided between the upper brush cover 23 and the second fire hose feeding means 37. A third sensor or a second metal detecting device 75 is provided between the first and second fire hose feeding means 36 and 37. Further, a fourth sensor or a connector detecting sensor 76 is provided at a downstream side of the first fire hose feeding means 36 in the hose feeding direction.

The first sensor 73 is constituted by, for example, a light sensor, an image sensor, or the like for detecting the presence of the fire hose. Each of the second and third sensors 74 and 75 is constituted by, for example, an image sensor for discriminating between the fire hose and a metal connector for connection thereof. The fourth sensor 76 is provided for merely detecting the passage of the metal connector of the fire hose and therefore it may be constituted by, for example, a limit switch. A detection plate 78 is pivotally supported by a fulcrum 77 and is always elastically urged to move clockwise in the drawing. The limit switch 76 is arranged so as to be actuated by the counterclockwise swing of the detection plate 78. The counterclockwise swing of the detection plate 78 is limited by a stopper 79. It is a matter of course that the sensors are not limited to the aforementioned examples and that other sensors such as magnetic sensors and generally used micro switches may be employed.

The detection output signals of the sensors 73, 74, 75 and 76 are fed into the control box 21, so that rotation control of the supporting arm driving motor 59, rotation control of the capstan driving motor 39 and rotation control of the brush driving motor 28 are carried out through the control box 21. As shown in FIG. 1, plates 81 for supporting the metal connector of the fire hose are provided in the feeding path between the downstream side of the washing brushes 22 with respect to the hose feeding direction and the second fire hose feeding means 37 and between the first and second fire hose feeding means 36 and 37, to thereby prevent the metal connector and the fire hose from hanging down by the weight of the metal connector.

The control box 21 shown in FIG. 1 is provided with a main switch 88 for the ON/OFF operation of an electric source, a selection switch 89 for selecting any one of washing of the fire hose, interruption of washing, and clamping of the fire hose, and a start button 91 for giving instructions to start washing.

In the following, the washing operation of the fire hose washing apparatus configured as described above is described in detail with reference to FIGS. 8 through 13 and FIG. 30.

In this embodiment, a so-called lead hose 83 having a whole length of about 1.5 m is used when a fire hose 82 is cleaned. In the case where the fire hose 82 to be cleaned has a male metal connector 84 at its forward end, the lead hose 83 and the fire hose 82 are connected to each other by screwing the male metal connector 84 of the fire hose 82 into a female metal connector 85 of the lead hose 83. In the case where the fire hose 82 has a female metal connector 86 (Refer to FIG. 12) at its forward end, the lead hose 83 and the fire hose 82 are connected to each other by screwing a male metal connector 87 of the lead hose 83 into the female metal connector 86 of the fire hose 82. After the lead hose 83 is connected to a fire hose in such a manner as described above, a plurality of fire hoses 82 to be cleaned is successively connected to form a series of fire hoses 82. The hose connecting work may be carried out in parallel to the washing work.

Figure 8:
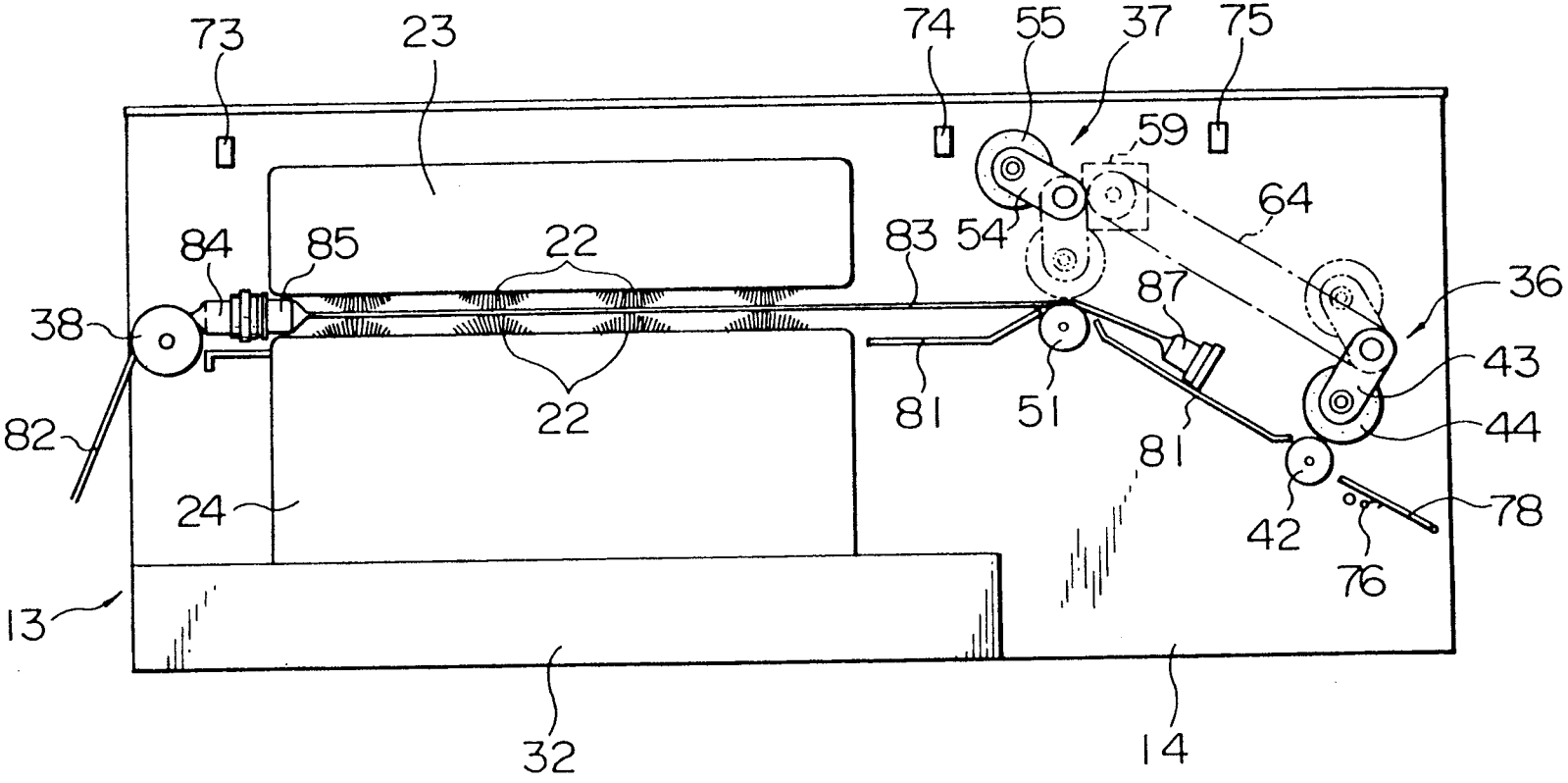
FIGS. 8 through 13 are explanatory views showing the operations of the first and second fire hose feeding means.

The thus serially connected fire hoses 82 are arranged first so that the not-connected metal connector 87 of the lead hose 83 is placed between the first and second fire hose feeding means 36 and 37; the lead hose 83 is inserted between the washing brushes 22; and the connected metal connector 84 is placed in the upstream side of the washing brushes 22 with respect to the hose feeding direction. In this condition, as shown in FIG. 8, the supporting arm 54 of the second fire hose feeding means 37 is in a stoppage position indicated by the solid line and rotated clockwise at 120 degrees from an operative position (feeding position) indicated by the broken line. On the other hand, the pinch roller 44 of the first fire hose feeding means 36 is operative, or in other words the pinch roller 44 is in contact with the capstan 42. The main and selection switches 88 and 89 on the control box 21 are in the states of "ON" and "CLEANING", respectively. In this condition, the first, second, third and fourth sensors 73, 74, 75 and 76 are in the states of "ON" (hose detected), "OFF" (metal connector not detected), "ON" (metal connector detected) and "OFF" (metal connector not detected), respectively.

Figure 9:
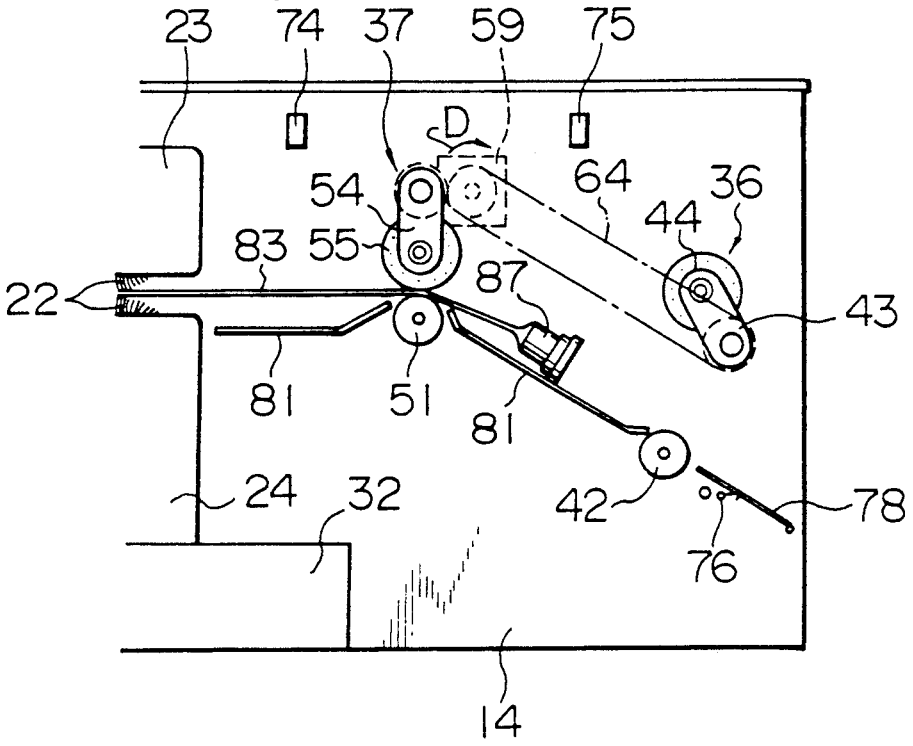

When the start button 91 is turned ON in the state of "READY" as shown in FIG. 8, the supporting arm driving motor 59 rotates clockwise (in the direction of the arrow D) as shown in FIG. 9 to thereby rotate the supporting arm 54 of the second fire hose feeding means 37 counterclockwise through the gear 58 from the position shown in FIG. 8. At the same time, the supporting arm driving chain 64 is driven to rotate the supporting arm 43 of the first fire hose feeding means 36 clockwise from the position shown in FIG. 8. This rotation of the supporting arm 43 is continued till the dog 65 is detected by the limit switch 66 so as to indicate the fact that the pinch roller 55 has come opposite to the capstan 51 to thereby clamp the lead hose 83 sufficiently.

Then the rotation of the capstan driving motor 39 and the rotation of the brush driving motor 28 start, and, on the other hand, washing water is ejected out of the pipes 31 through the nozzles 35. Thus, the metal connector 84 of the fire hose 82 comes between the washing brushes 22 which have started the washing work, and, at the same time, the free end of the metal connector 87 of the lead hose 83 has passed through the first fire hose feeding means 36 and comes onto the detection plate 78. Accordingly, the detection plate 78 is turned downward, so that the fourth sensor 76 is caused to turn ON mechanically. In the control circuit of the control box 21, however, the fourth sensor 76 is established to be in the state of "OFF" in view of an electric signal "ON" of the first sensor 73 . Accordingly, the first fire hose feeding means 36 is opened to be in a stoppage state as shown in FIG. 9, and the second fire hose feeding means 37 feeds the lead hose 83 so that the metal connector 84 of the fire hose 82 and the hose body following the metal connector 84 are cleaned by the washing brushes 22. Because the washing is carried out by rotating the washing brushes 22 in the direction opposite to the fire hose 82 feeding direction as described above, the washing force is very strong. In this embodiment, the washing brushes 22 have enough long hairs to eliminate the necessity of evacuating the washing brushes 22 when the metal connector 84 passes through between the washing brushes 22.

Figure 10:
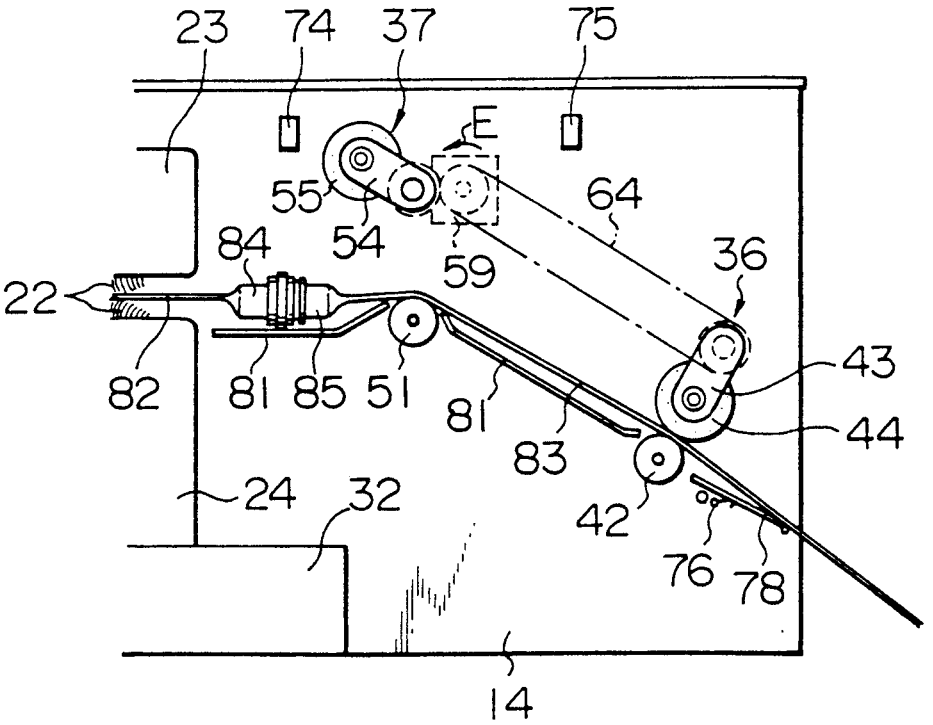

The lead hose 83 is fed as described above till the metal connector 84 following after the lead hose 83 comes to a position between the washing brushes 22 and the second fire hose feeding means 37 as shown in FIG. 10, at which the second sensor 74 detects the presence of the metal connector 84 and supplies a detection signal to the control box 21. In response to the detection signal, the control box 21 stops the rotation of the brush driving motor 28 and the capstan driving motor 39, and, at the same time, stops the supply of the washing water. Then, the supporting arm driving motor 59 is rotated in the direction reverse to the aforementioned washing start state, that is, rotated counterclockwise (in the direction of the arrow E) in FIG. 10. Accordingly, the supporting arm 43 of the first fire hose feeding means 36 and the supporting arm 54 of the second fire hose feeding means 37 are rotated clockwise and counter clockwise respectively from the positions shown in FIG. 9, so that the dog 65 rotates by 120 degrees to come into contact with the limit switch 66 to thereby stop the rotation of the supporting arm driving motor 59. By this operation, the pinch roller 55 is evacuated from the feeding path, and, on the contrary, the pinch roller 44 is placed opposite to the capstan 42 to thereby clamp the lead hose 83. After the movement of the supporting arms 43 and 54 is finished, the rotation of the brush driving motor 28 and the rotation of the capstan driving motor 39 start, and, at the same time, the supply of washing water starts.

The washing is carried out as described above till the metal connector 84 comes to a position between the first and second fire hose feeding means 36 and 37, at which the third sensor 75 detects the presence of the metal connector 84 so that the rotation of the brush driving motor 28 and the rotation of the capstan driving motor 39 are stopped, and, at the same time, the supply of washing water is stopped. Then, the supporting arm driving motor 59 is rotated clockwise (in the direction of the arrow F) in FIG. 11 to rotate the supporting arms 54 and 43 counterclockwise and clockwise, respectively from the positions shown in FIG. 10. Accordingly, the pinch roller 55 is placed opposite to the capstan 51 through the fire hose 82 while the pinch roller 44 is evacuated from the feeding path. After the movement of the supporting arms 43 and 54 is finished, the rotation of the brush driving motor 28 and the rotation of the capstan driving motor 39 are started again, and, at the same time, the supply of washing water is also started again.

As described above, the fire hose 82 is fed by the second fire hose feeding means 37 while the washing is carried out till a next metal connector 84 of a next fire hose reaches the detection position of the second sensor 74. When the next metal connector 84 reaches the detection position of the second sensor 74, the pinch roller 55 is evacuated as shown in FIG. 10, and the fire hose 82 is clamped between the pinch roller 44 and the capstan 42 so as to be fed while the washing is carried out. The operations shown in FIGS. 10 and 11 are repeated alternately till the metal connector 86 of the last fire hose 82 reaches the detection position of the second sensor 74.

When the last metal connector 86 reaches this position, the first sensor 73 turns OFF to thereby detect the absence of the fire hose 82 in the upstream side of the washing brushes 22 with respect to the feeding direction. When the last metal connector 86 reaches the detection position of the second sensor 74, the brush driving motor 28 and the capstan driving motor 39 are stopped and, at the same time, the supply of washing water is stopped.

Figure 11:
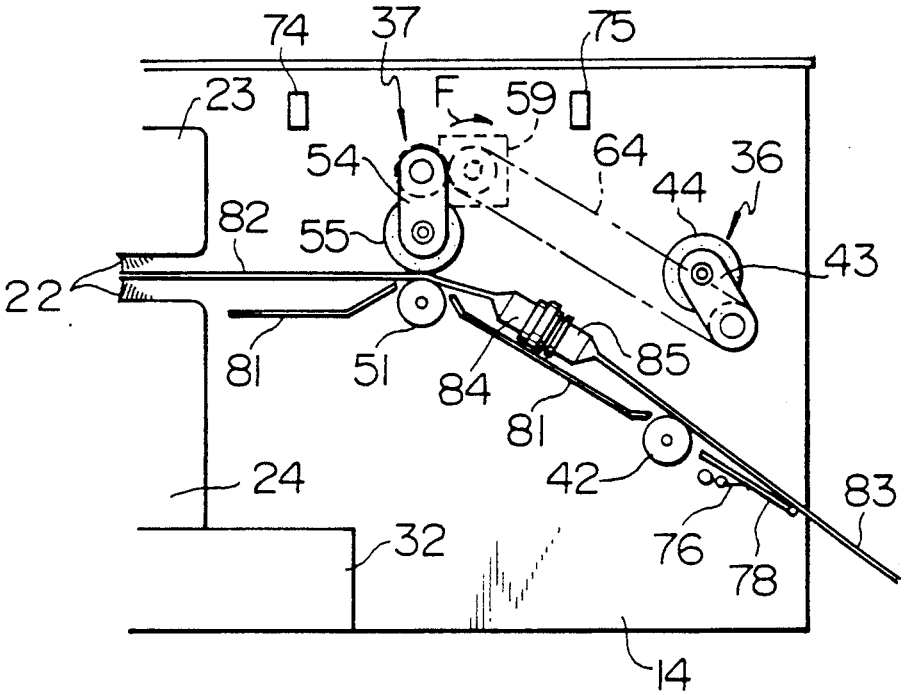
Figure 12:
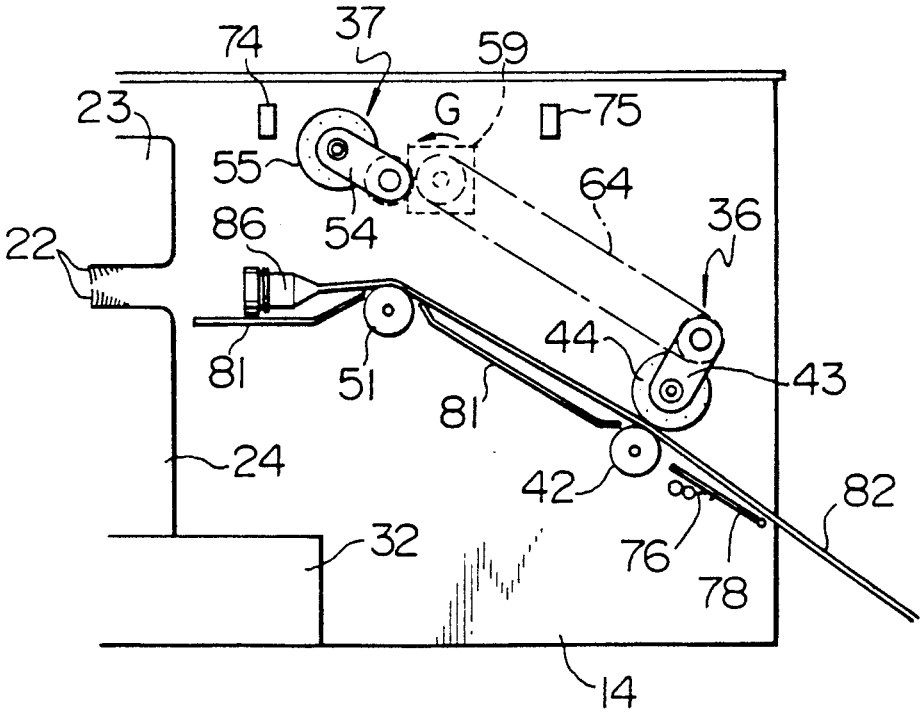
Figure 13:
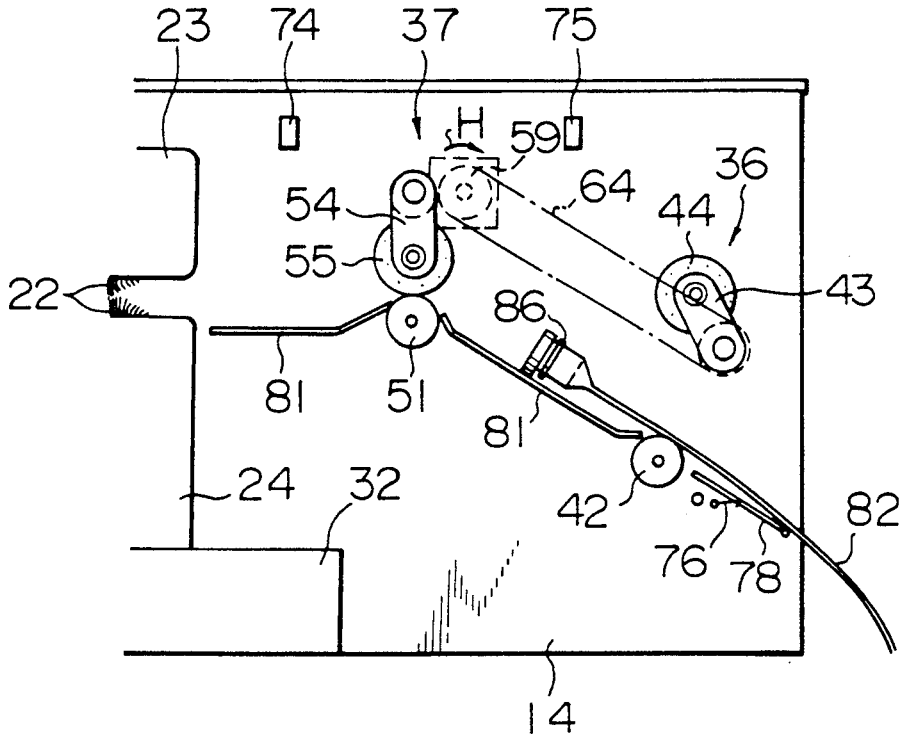

Then, the supporting arm driving motor 59 is rotated counterclockwise (in the direction of the arrow G) in FIG. 12 to rotate the supporting arm 54 clockwise from the position shown in FIG. 11 to thereby evacuate the pinch roller 55, and, at the same time, to rotate the supporting arm 43 counterclockwise from the position shown in FIG. 11 to thereby place the pinch roller 44 opposite to the capstan 42 through the fire hose 82. When the fire hose 82 is clamped between the pinch roller 44 and the capstan 42, the capstan driving motor 39 alone rotates. When the metal connector 86 comes then to a position between the first and second fire hose feeding means 36 and 37, the third sensor 75 detects the presence of the metal connector 86 so that the capstan motor 39 stops in response to the detection and, at the same time, the supporting arm driving motor 59 rotates clockwise (in the direction of the arrow H) in FIG. 13. Accordingly, the supporting arms 43 and 54 are rotated counterclockwise and clockwise respectively from the positions shown in FIG. 12. By the rotation of the supporting arms, the pinch roller 44 of the first fire hose feeding means 36 is evacuated from the feeding path and, at the same time, the pinch roller 55 of the second fire hose feeding means 37 is placed opposite to the capstan 51. In this condition, the capstan driving motor 39 does not rotate any more, and the last fire hose 82 is pulled out manually along the supporting plate 81. When the fire hose 82 is pulled out as described above, the metal connector 86 of the last fire hose 82 turns the detection plate 78 downward so that the ON operation of the fourth sensor 76 becomes valid in the control circuit. Accordingly, the supporting arm driving motor 59 rotates counterclockwise to thereby rotate the supporting arms 54 and 43 clockwise and counterclockwise from the positions shown in FIG. 13 to the initial positions shown in FIG. 8, respectively.

Thus, the fire hoses 82 are fed while the supporting arms 43 and 54 alternately avert the metal connectors 84 and 86. The rotation of the washing brushes 22 does not stop except the case where the metal connector 84 passes the two fire hose feeding means 36 and 37, so that the fire hoses 82 can be cleaned continuously while being fed at a high speed.

In the washing work, the fire hose 82 may be wound on a reel in advance so that the fire hose can be rewound on the real after washing or can be easily dried while extended after washing. Because the female and male metal connectors 85 and 87 are attached to the lead hose 83 respectively, the female or male metal connector 85 or 87 of the lead hose 83 can be connected the male or female metal connector 84 or 86 of the fire hose 82 to be cleaned, so that the loading of the fire hose 82 can be carried out with no trouble regardless of the type of the metal connector provided at the forward end of the fire hose 82.

Although the aforementioned first embodiment has shown the case where the respective supporting arms 43 and 54 for supporting the pinch rollers 44 and 45 are actuated by the supporting arm driving motor 59 to form a mechanism for evacuating the pinch rollers from the metal connector 84, the invention can be applied to the case where another known driving means, such as an electric cylinder, an oil cylinder, an air cylinder, cam means or the like, may be employed as a driving means. Relating to this, the invention can be made so that not only the pinch rollers 44 and 55 but the capstans 42 and 51 may be evacuated from the metal connector 84.

Figure 14:
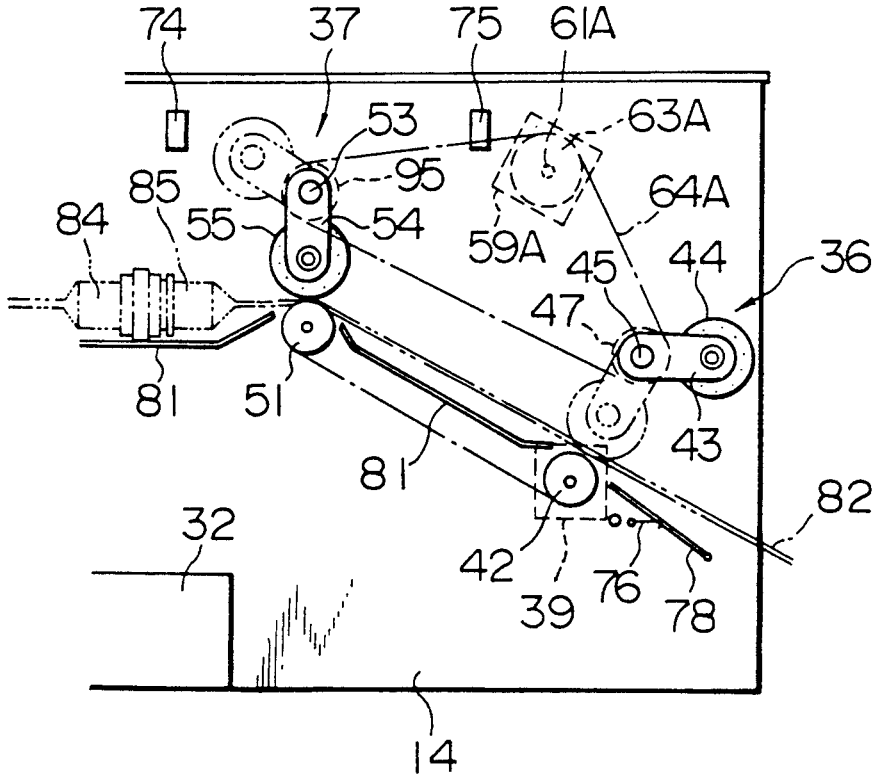
FIG. 14 is an explanatory view schematically showing another example of the supporting arm as a second embodiment of the invention.

In the aforementioned first embodiment, the rotary shaft 53 of the supporting arm 54 is rotated through the gear 57 engaged with the gear 58 coaxially mounted on the driving shaft 61 of the motor 59. However, the rotation of the motor may be transmitted to the rotary shafts 45 and 53 of the supporting arms 43 and 54 through a transmission member such as a chain or the like as illustrated in a second embodiment of the present invention shown in FIG. 14. In short, in the second embodiment, a motor 59A is provided at a position far from the rotary shafts 45 and 53, preferably, at a position of the vertex of an equilateral triangle containing a virtual line connecting the rotary shafts 45 and 53 as the base thereof. Further, an endless chain 64A is entrained over a sprocket 63A of a driving shaft 61A of the motor 59A and a sprocket 95 provided on the rotary shaft 53. In the second embodiment, the pinch rollers 44 and 55 can be alternately operated by the positive and reverse rotation of the motor 59A similarly to the first embodiment.

Figure 15:
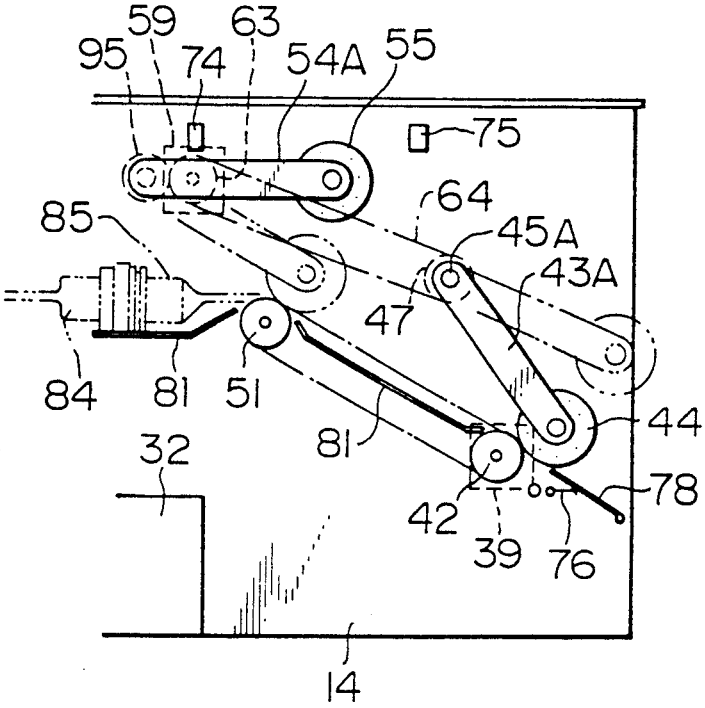
FIG. 15 is a schematic front view showing a modification of the supporting arm driving means as a third embodiment of the invention.
Figure 16:
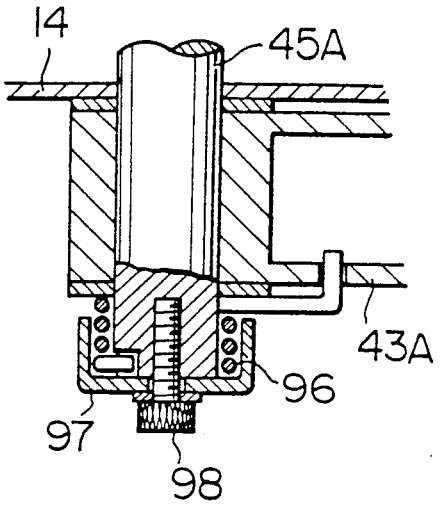
FIG. 16 is a side view showing the vicinity of the rotary shaft of the supporting arm depicted in FIG. 15.

In the first embodiment, the supporting arms 43 and 54 are arranged so as to be rotated at the upstream side of their respective driving shafts 45 and 53 with respect to the direction of feeding the fire hose 82. In a third embodiment of the invention as shown in FIG. 15, however, supporting arms 43A and 54A are extended to the downstream side in the firehose feeding direction. In short, the supporting arm 43A is arranged so that the supporting arm 43A comes in contact with the pinch roller 42 when the supporting arm 43A is rotated clockwise about 30 degrees from the stoppage position thereof shown by the two-dotted chain line in FIG. 15. A rotary shaft 45A of the supporting arm 43A is arranged so as to be rotated further about 10 degrees by the motor 59. As shown in FIG. 16, a coil spring 96 having one end fixed to the rotary shaft 45A and the other end fixed to the supporting arm 43A is put on the rotary shaft 45A. The coil spring 96 serves to give clockwise rotating force to the supporting arm 43A. The coil spring 96 is covered with a cap 97 which is fixed to the rotary shaft 45A by a screw 98. Similarly, the supporting arm 54A is arranged so that the supporting arm 54A comes to contact with the pinch roller 51 when the supporting arm 54A is rotated clockwise about 30 degrees from the stoppage position thereof shown by the solid line in FIG. 15. Further, though not shown, a coil spring serving to give clockwise rotating force to the supporting arm 54A is provided on the rotary shaft of the supporting arm 54A in the same manner as the rotary shaft 45A.

Accordingly, when, for example, the supporting arm 43A is rotated clockwise about 30 degrees from the stoppage position thereof by the motor 59, the supporting arm 43A comes to contact with the pinch roller 42 so that the fire hose 82 can be fed out while clamped between the supporting arm 43A and the pinch roller 42. When the rotary shaft 45A rotates further for 10 degrees, elastic urging force is produced in the supporting arm 43A by the coil spring 96 so that the clamping of the fire hose 82 can be more secured.

In the case where the fire hose 82 discharged out of the washing apparatus is put in order like a fan fold, the number of stages of the fan fold shape of the fire hose is limited if the capstan 42 of the first fire hose feeding means 36 is provided at a lower position of the front panel 14 as described above in the first embodiment.

Figure 17:
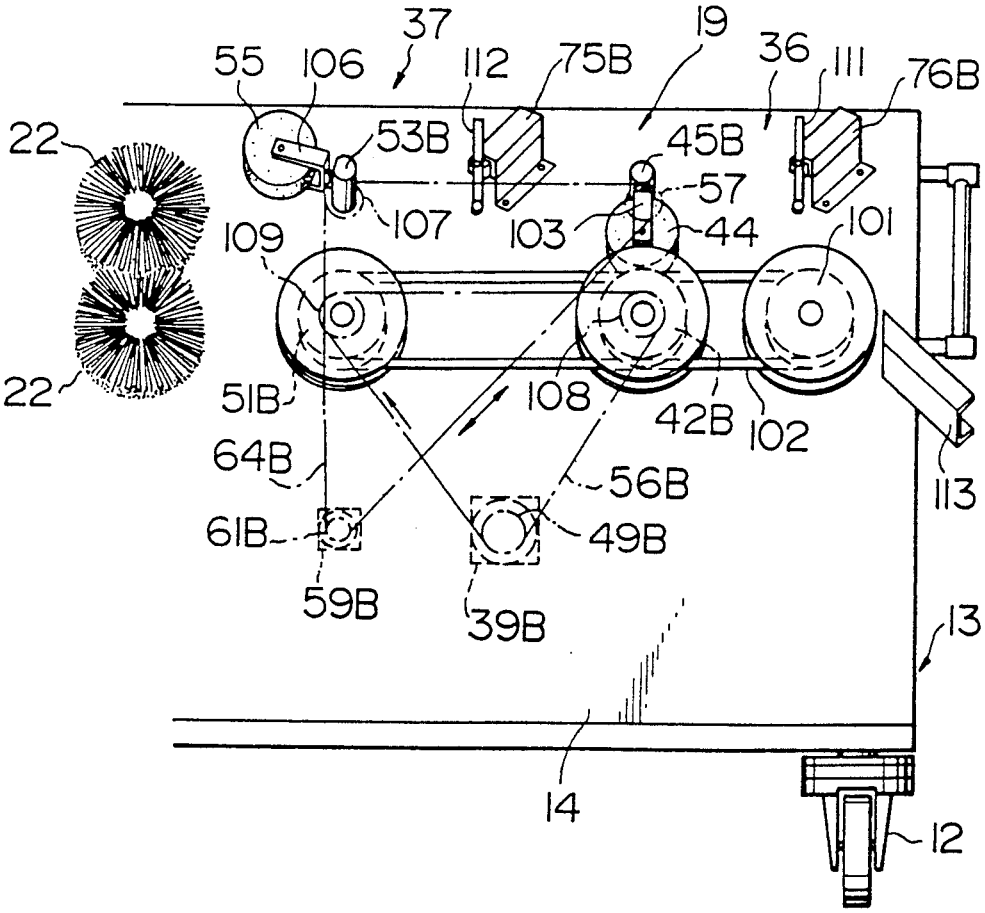
FIG. 17 is a front view of a fire hose feeding portion as a fourth embodiment of the invention.
Figure 18:
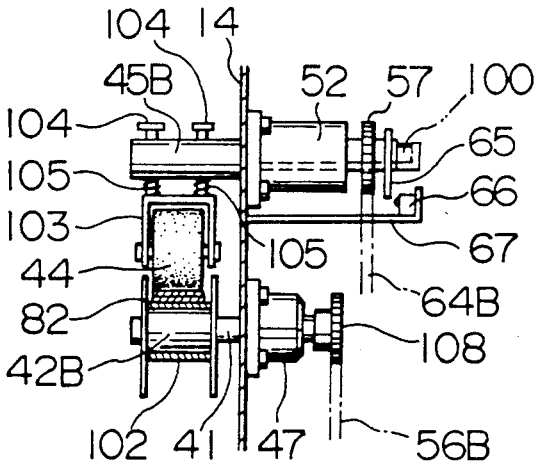
FIG. 18 is a right side view of the fire hose feeding portion.

In a fourth embodiment, therefore, an idler 101 as shown in FIGS. 17 and 18 is provided in addition to capstans 42B and 51B so that the fire hose feeding portion 19 is arranged linearly horizontally with respect to the discharge direction of the washing brushes. In short, the fire hose feeding portion 19 in the fourth embodiment is arranged so that the nip between the capstan 51B and the pinch roller 55 and the nip between the capstan 42B and the pinch roller 44 are placed on a line extended horizontally from the contacting portions of the hairs of the washing brushes 22 arranged in the upper and lower sides and that the idler 101 is arranged on the further horizontally extension. Each of the capstans 42B and 51B and the idler 101 is shaped like a pulley. A feeding belt 102 for putting the fire hose 82 thereon is entrained over between the capstan 51B and the idler 101, so that the capstan 42B is placed between the capstan 51B and the idler 101.

As shown in the partly sectional view of FIG. 18, the pinch roller 44 is rotatably supported by a substantially U-shaped supporting arm 103 which is mounted on the rotary shaft 45B by two supporting shafts 104 slidably piercing the rotary shaft 45B in the direction of the diameter thereof. Coil springs 105 are disposed on the respective supporting shafts 104 and between the supporting arm 103 and the rotary shaft 45B. The coil springs 105 always elastically urge the supporting arm 103 in the direction opposite to the rotary shaft 45B. Though not shown, the pinch roller 55 is supported by a supporting arm 106 in the same manner as the pinch roller 44. The pinch rollers 44 and 55 are driven by the chain 64B entrained over the sprockets 57 and 107 provided at the end portions of the rotary shafts 45B and 53B of the supporting arms 103 and 106 in the rear side of the front panel 14 and the sprocket 61B provided on the rotary shaft of the supporting arm driving motor 59B. In this embodiment, the supporting arm driving motor 59B is installed at the lower portion of the rear side of the front panel 14 to form a substantially equilateral triangle with respect to the sprockets 107 and 57. The positions of engagement of the sprockets 107 and 57 with the chain 64B are considered in advance so that the pinch rollers 44 and 55 are moved relatively with a difference of 120 degrees.

To detect the rotation angles of the pinch rollers 44 and 55, a dog 65 for detecting the 120-degrees rotated position of the pinch roller 44 is provided on the rotary shaft 45B of the pinch roller 44 in the same manner as in the first embodiment. In this embodiment, a limit switch 100 is provided to be engaged with the dog 65 as shown by the dot line in FIG. 18 so that the supporting arm driving motor 59B slightly rotates counterclockwise in FIG. 17 and then stops.

On the other hand, sprockets 108 and 109 are mounted, at the rear side of the front panel 14, on the rotary shafts 41 and 50 of the capstans 42B and 51B, respectively. Further, a capstan driving motor 39B is provided at the rear side of the front panel 14. A chain 56B is entrained over the sprocket 49B mounted on the rotary shaft of the capstan driving motor 39B and the sprockets 108 and 109, so that the capstans 42B and 51B, the feeding belt 102 and the idler 101 are rotated clockwise (in the direction of discharge of the fire hose) in FIG. 17. Third sensor or a second metal detecting device 75B and a fourth sensor 76B constituted by switching means, such as limit switches, proximity switches or the like, operated by contact with the metal connectors 84 . . . 87 of the fire hose 82 and lead hose 83 are provided between the capstans 42B and 51B and in the downstream side of the capstan 42B with respect to the hose feeding direction. The third and fourth sensors 75B and 76B detect the fact that detection arms 111 and 112 rotatably mounted on the sensors 76B and 75B are rotated by contact with the metal connectors 84 . . . 87, respectively. A guide 113 for guiding the fire hose from the washing apparatus body to the outside is mounted in the downstream side of the idler 101. Other parts not described particularly are constructed in the same manner as in the aforementioned embodiment.

In the following, the washing operation of the fire hose washing apparatus in the fourth embodiment as described above is described with reference to the explanatory views of FIGS. 19 through 23.

Figure 19:
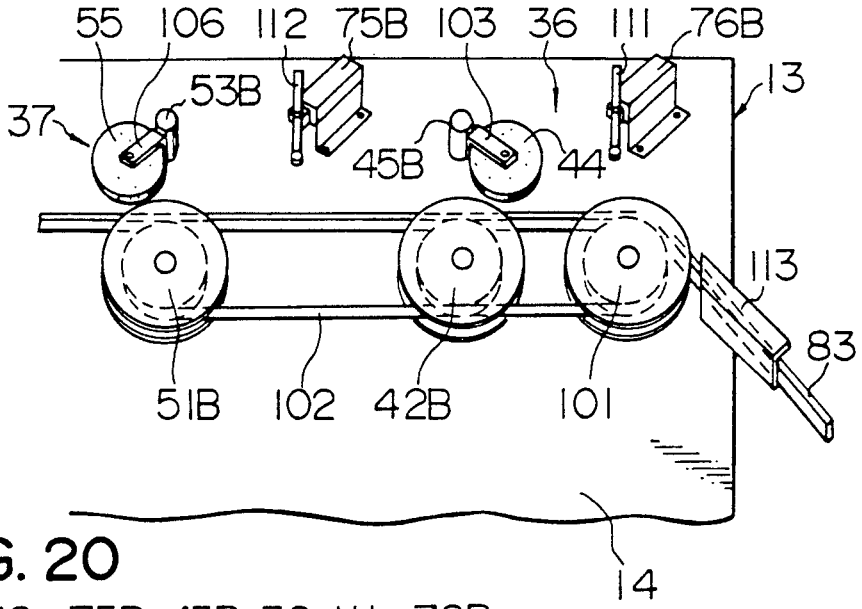
FIGS. 19 through 23 are explanatory views showing the conditions of feeding of the fire hose in the fourth embodiment.

FIG. 19 shows the condition in which the lead hose 83 has been set up. The lead hose 83 is set up as follows. When the main switch 88 and the selection switch 89 of the control box 21 (Refer to FIG. 1) are turned to "ON" and "CLAMP", respectively, the supporting arm driving motor 59B slightly rotates counterclockwise from the position of FIG. 17 and then stops because of the engagement of the dog 65 with the limit switch 100. Accordingly, both the pinch rollers 44 and 55 become apart from the capstans 42B and 51B and the feeding belt 102. Here, the lead hose 83 is passed between the upper and lower groups of washing brushes 22 and placed on the feeding belt 102 between the capstan 51B and the pinch roller 55 and between the capstan 42B and the pinch roller 44 and, on the other hand, the metal connector 103 is led out of the front panel 14 through the guide 113.

Figure 20:
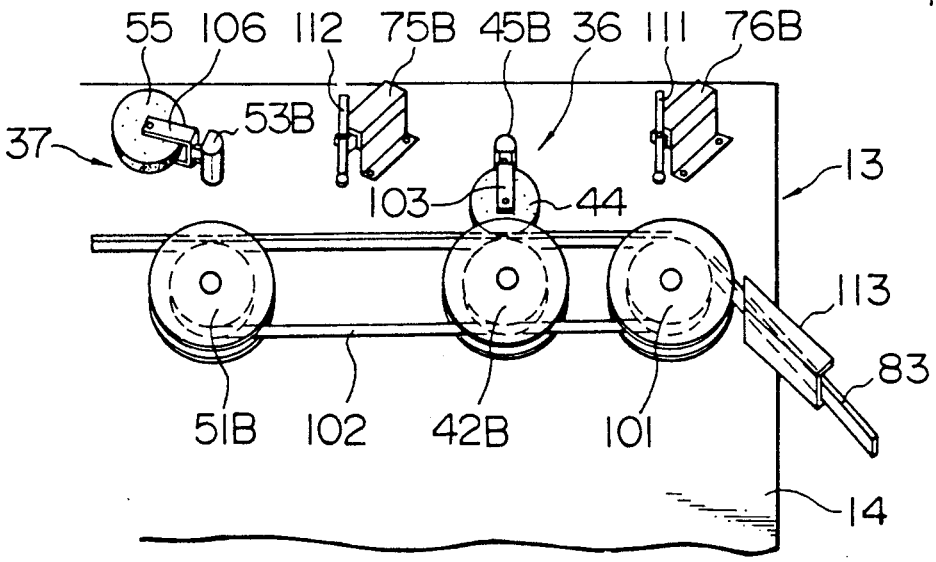
Figure 21:
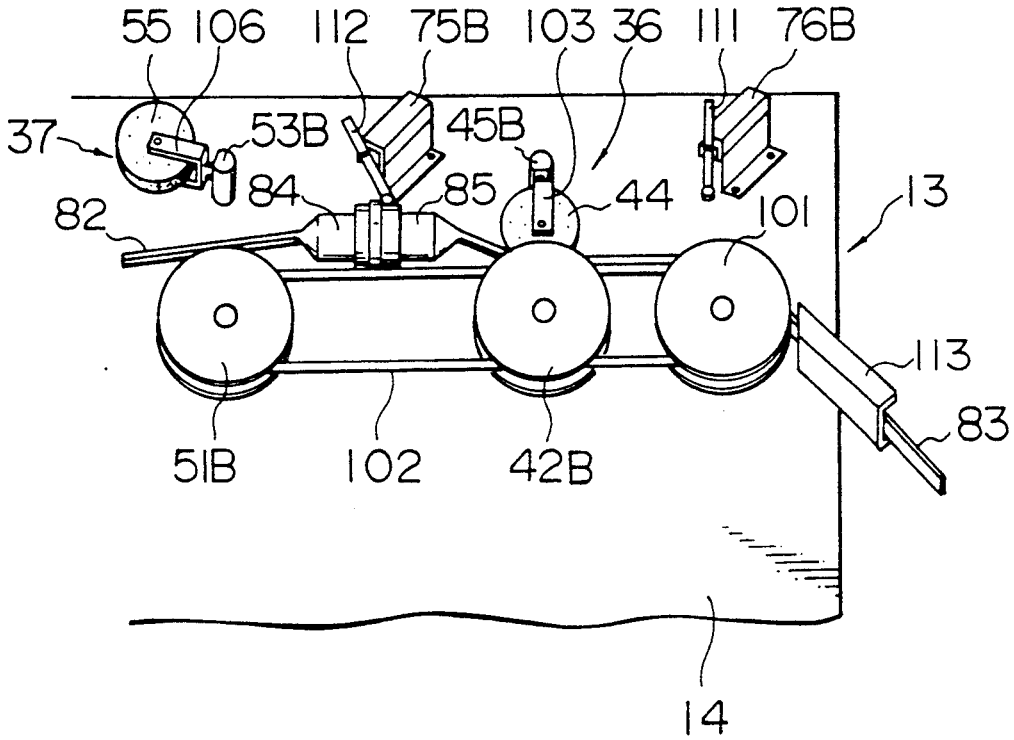
Figure 22:
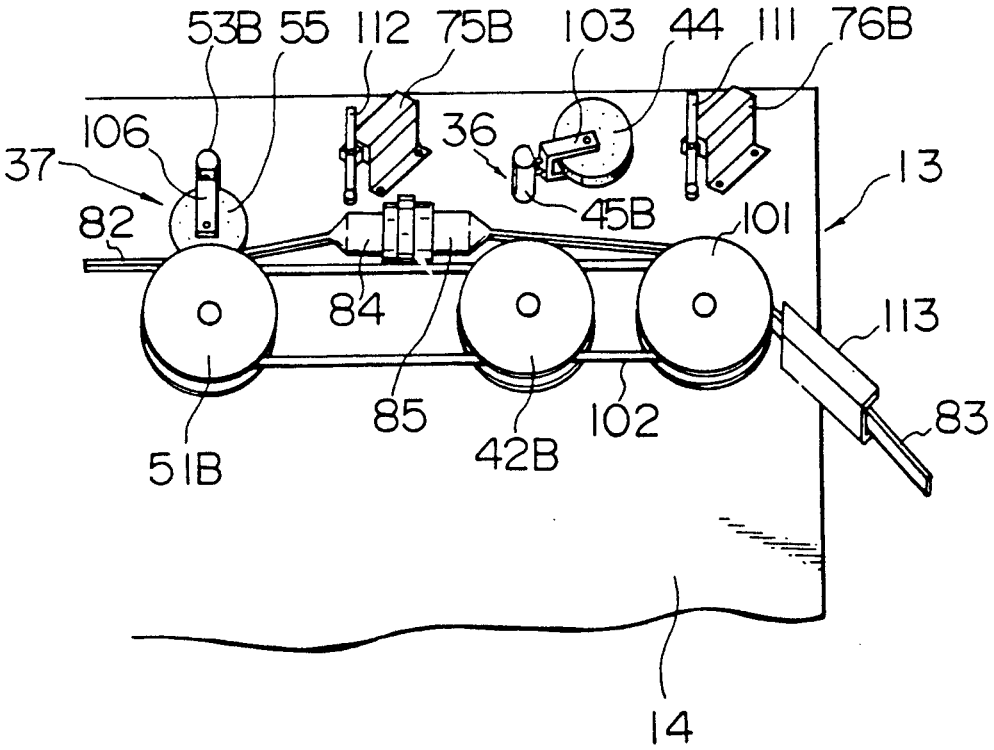
Figure 23:
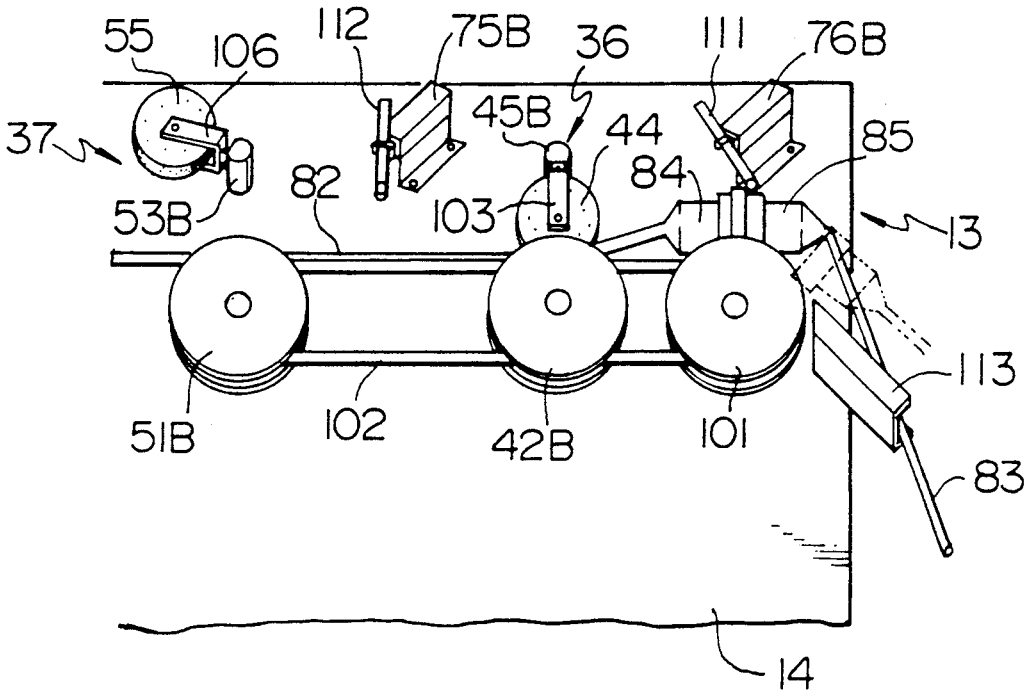

When the selection switch 89 is turned from this position to the position of "CLEANING", the supporting arm driving motor 59B rotates clockwise in FIG. 17 to move the chain 64B in the same direction. The pinch roller 44 at the downstream side in the feeding direction comes in forced contact with the capstan 42B as shown in FIG. 20 to thereby clamp the lead hose 83 between the feeding belt 102 and the pinch roller 44, while the pinch roller 55 is placed at a position farthest from the capstan 51B. When the lead hose 83 is clamped as described above, the rotation angle is detected by the dog 65. The supporting arm driving motor 59B stops in response to the detection of the rotation angle and then the capstan driving motor 39B starts to rotate clockwise in FIG. 17. Accordingly, the lead hose 83 is fed to right in FIG. 20. When the metal connector 84 at the backward end of the lead hose 83, that is, at the forward end of the fire hose 82, makes the detection arm 112 of the third sensor 75B rotate as shown in FIG. 21, the limit switch of the third sensor 75B detects the rotation of the arm 112 to tell the control circuit of the control box that the metal connector 84 reaches the detection position of the third sensor 75B. In this condition, the control circuit of the control box 21 makes the capstan driving motor 39B stop and makes the supporting arm driving motor 59B rotate counterclockwise till the rotation angle of 120 degrees is detected by the dog 65. Accordingly, the pinch roller 44 becomes apart from the capstan 42B as shown in FIG. 22 to be evacuated from the feeding path of the fire hose 82. At the same time, the pinch roller 55 comes into contact with the capstan 51B to clamp the fire hose 82 together with the feeding belt 102 between the pinch roller 55 and the capstan 51B. Then, the capstan driving motor 39B rotates clockwise according to the instruction issued from the control circuit of the control box 21 to thereby feed the fire hose 82. When the metal connector 84 then comes into contact with the detection arm 111 of the fourth sensor 76B to turn ON the sensor 76B as shown in FIG. 23, the passage of the metal connector 84 through the two pinch rollers 44 and 55 is finished.

When the metal connector 84 has passed through the two pinch rollers 44 and 55 as described above to reach the position of the fourth sensor 76B, the capstan driving motor 39B stops and, at the same time, the supporting arm driving motor 59B rotates clockwise till the rotation angle of 120 degrees is detected by the dog 65. Accordingly, the pinch roller 44 comes into contact with the capstan 42B to clamp the fire hose 82 together with the feeding belt 102 between the capstan 42B and the pinch roller 44. Then, the capstan driving motor 39B rotates clockwise so that the fire hose 82 is continuously fed while the washing is carried out at the washing portion 18 till the third sensor 75B is turned ON by the next metal connector, that is, the metal connector 86 at the backward end of the fire hose 82.

According to the fourth embodiment, the washing of the fire hose 82 can be made efficiently by changing the driving direction of the capstan driving motor 39B automatically corresponding to the detection position of the metal connectors 84 . . . 87 and, furthermore, the folding of the fire hose like fan fold after the washing can be made following the discharge from the apparatus. According to the fourth embodiment, the second sensor 74 used in the first embodiment becomes unnecessary.

Although the respective embodiments have shown the case where two capstans and two pinch rollers are provided to pass the metal connectors 84 . . . 87 by alternating the clamping operations thereof so that the respective capstans can clamp the fire hose 82, the invention is applicable to the case where only one pair of capstan and pinch roller are used for feeding the fire hose 82. This, fifth embodiment is described with reference to FIGS. 24 and 25.

Figure 24:
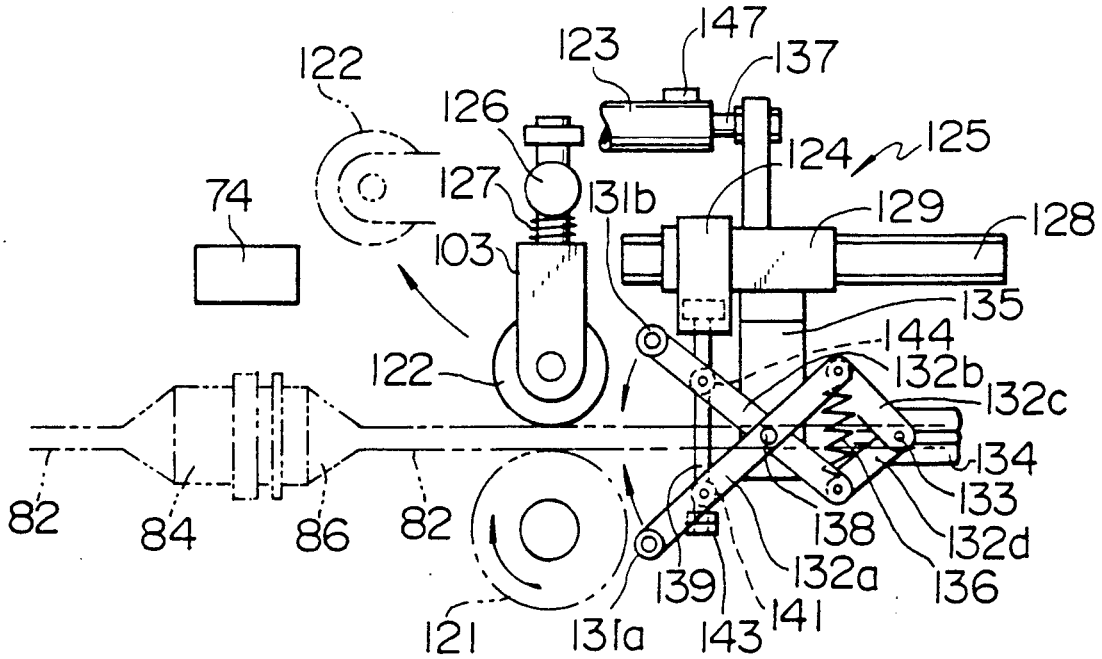
FIG. 24 is a front view showing the schematic configuration of a fire hose feeding portion as a fifth embodiment of the invention.

FIG. 24 is a front view showing the schematic configuration of the fire hose feeding portion having a capstan 121, a pinch roller 122 provided opposite to the capstan 121 so as to be movable relative to the capstan 121, and a hose clamping and feeding mechanism 125 operated by first and second air cylinder 123 and 124. In the fifth embodiment and other embodiments which will be described later, the capstan 121 and the pinch roller 122 are equivalent to the second fire hose feeding means 37 in the first embodiment; and the hose clamping and feeding mechanism 125 corresponds to the first fire hose feeding means 36.

In the fifth embodiment, the capstan 121 is rotated clockwise in FIG. 24 by a capstan driving motor not shown; and the pinch roller 122 is rotatably supported on a rotary shaft 126 actuated by a supporting arm driving motor not shown and is always urged by a coil spring 127 to move apart from the rotary shaft 126. The rotary shaft 126 is movable between the stoppage position indicated by the two-dotted chain line in FIG. 24 and the clamping position indicated by the solid line in FIG. 24, that is, in a range of about 90 degrees, in accordance with the driving of the supporting arm driving motor.

The hose clamping and feeding mechanism 125 has two cylinders, that is, the first air cylinder 123 and the second air cylinder 124, rails 128 provided on the front panel 14 in parallel to the feeding direction of the fire hose 82, and a rail support 129 for moving the whole of the hose clamping and feeding mechanism 125 in parallel to the feeding direction of the fire hose 82 along the rails 128 in accordance with the operation of the first air cylinder 123. The hose clamping and feeding mechanism 125 further has a pair of link plates **132*a* and 132*b* including clamping portions 131*a* and 131*b* for clamping the fire hose 82 by means of the second air cylinder 124, link members 132*c* and 132*d* forming lazy tongs in combination with the link plates, a guide rail 134 having a section substantially C-shaped and provided for guiding linearly a supporting shaft 133 of the link members 132*c* and 132*d*, a link plate holding plate 135 provided for movably supporting the link plates 132*a* and 132*b* and integrally fixed to the rail support 129, and a tension coil spring 136 for always elastically urging the link plates 132*a* and 132*b*** to move apart from each other.

Figure 25:
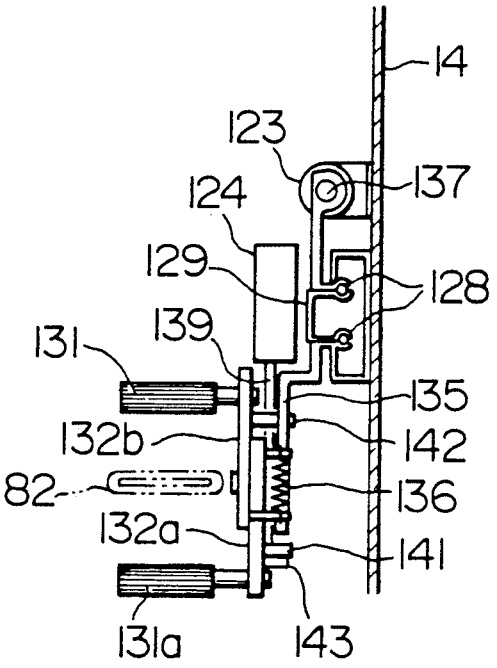
FIG. 25 is a right side view of the fire hose feeding portion of FIG. 24.

The rail support 129 is connected to an end of a piston rod 137 moved forward and backward by the first air cylinder 123 so that the rail support 129 is slidable along the two rails 128 as shown in FIG. 25, and the rail support 129 serves to support the link plates **132*a* and 132*b* through a pivotal pin 138. Engagement/stoppage portions 141 and 142 engaged with a piston rod 139 of the second air cylinder 124 are provided between the pivotal pin of the link plates 132*a*, 132*b* and the clamping portions 131*a*, 131*b*, respectively. The engagement/-stoppage portions 141 and 142 are engaged with stoppers 143 and 144 provided at the lower end of the piston rod 139 as shown in FIG. 24, from the lower and upper sides, respectively. The second air cylinder 124 per se is connected to the link plates 132*a* and 132*b* through the piston rod 139 so as to be movable vertically in the drawing. The clamping portions 131*a* and 131*b* are fixed to the link plates 132*a* and 132*b*** so as to be immovable. Other parts not described particularly are constructed in the same manner as in the aforementioned embodiment.

The operation of the apparatus configured as described above is as follows. When the second sensor 74 (Refer to FIG. 1) detects the metal connectors 84, 86 of the fire hose 82 in the process of clamping and feeding the fire hose 82 between the capstan 82 and the pinch roller 122 as shown by the solid line in FIG. 24, the supporting arm driving motor not shown rotates to make the pinch roller 122 rotate clockwise in FIG. 24 around the rotary shaft 126 to thereby evacuate the pinch roller 122 to the standby position indicated by the two-dotted chain line. At the same time, the capstan driving motor stops, so that the feeding of the fire hose 82 is interrupted. Thereafter, the second air cylinder 124 is driven to move the piston rod 139 backward. It is therefore apparent from FIG. 24 that the clockwise movement of the link plate 132*a* and the upward movement of the link plate 132*b* are limited by the functions of the stoppers 143 and 144, respectively. However, the second air cylinder 124 moves down relatively as the piston rod moves back, so that the link plate 132*b* is rotated counterclockwise. When the second air cylinder 124 makes the piston rod 139 move back near to the maximum stroke, the fire hose 82 is clamped by the clamping portions 131*a* and 131*b*. When the fire hose 82 is securely clamped by the clamping portions 131*a* and 131*b*, the first air cylinder 123 operates to move the piston rod 137 forward and move the rail support 129 along the rails 128 in parallel to the feeding direction of the fire hose 82. When the movement approaches the full stroke of the piston rod 137, the piston detecting sensor 145 detects the rear end of the the piston rod 137 to stop the operation of the first air cylinder 123. Because at this point of time, the metal connectors 84, 86 have passed through the capstan 121, and the supporting arm driving motor rotates reversely in response to the ON operation of the piston detecting sensor 145, so that the fire hose 82 is clamped between the pinch roller 122 and the capstan 121. On the other hand, the second air cylinder 124 makes its piston rod 139 move forward to release the clamping of the fire hose 82 by the clamping portions 131*a* and 131*b* to operate the first air cylinder 123 reversely to return the rail support 129 to the initial position for standing by the next operation. The fire hose 82 is continuously fed by the rotation of the capstan driving motor while the washing is carried out.

Figure 26:
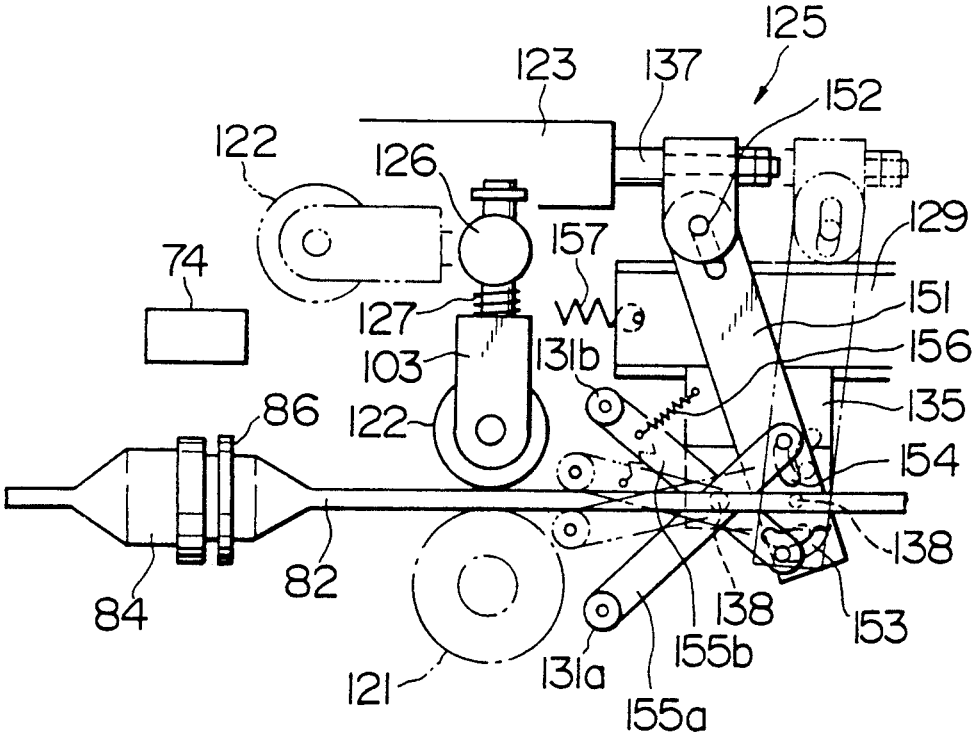
FIG. 26 is a front view showing the schematic configuration of a fire hose feeding portion as a sixth embodiment of the invention.
Figure 27:
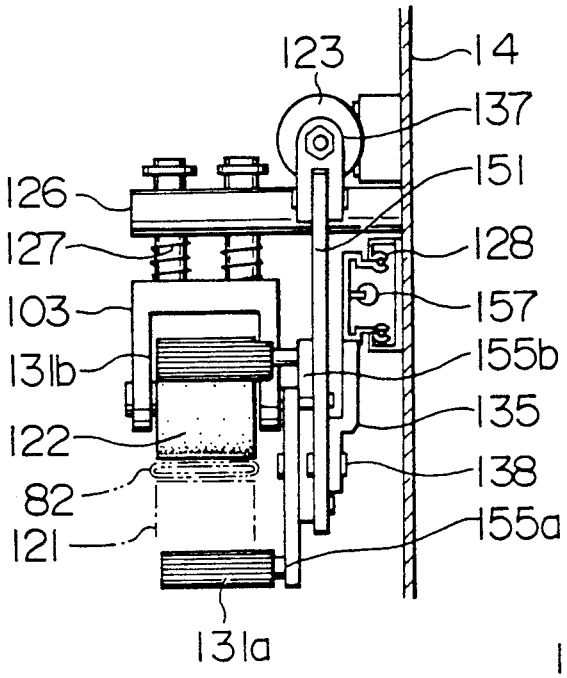
FIG. 27 is a right side view of the fire hose feeding portion of FIG. 26.

FIG. 26 shows a sixth embodiment of the invention using an air cylinder, in which the hose clamping and feeding mechanism 125 is composed of an air cylinder, a pair of link plates, and a rail support. Other parts are the same as in the fifth embodiment and, accordingly, different construction and the operation thereof will be described hereunder.

In the sixth embodiment, the air cylinder is the same as the first air cylinder 123. A link plate actuating plate 151 rotatably supported by a shaft at the lower end of the rail support 129 is linked with the piston rod 137 of the first air cylinder 123 so as to be movable along a guide slot 152. In the lower end of the the link plate actuating plate 151 in FIG. 26, cam slots 153 and 154 are formed. The one-end portions of link plates 155*a* and 155*b* rotatably supported at the pivotal pin 138 to the lower portion of the rail support 129 are engaged with the cam slots 153 and 154 to thereby limit the operations of the link plates 155*a* and 155*b* along the cam slots 153 and 154, respectively. The clamping portions 131*a* and 131*b* are fixed to the other end portions of the link plates 155*a* and 155*b* in the same manner as described above. The rail support 129 is provided with a tension spring 156 disposed between the rail support 129 and the link plate 155*b* to always urge the clamping portions 131*a* and 131*b* to move apart from each other. Further, a spring 157 is provided to always urge the rail support 129 reversely to the fire hose feeding direction.

The operation of the apparatus as described above is as follows. After the pinch roller 122 is evacuated upward in response to the detection of the metal connectors 84 and 86, the first air cylinder 123 operates to move the piston rod 137 forward. Consequently, the link plate actuating plate 151 rotates clockwise in FIG. 26. The one-end portions of the link plates 155*a* and 155*b* move along the cam slots 153 and 154 corresponding to the rotation of the link plate actuating plate 151, so that the clamping portions 131*a* and 131*b* approach each other against the elastic force of the tension spring 156 to thereby clamp the fire hose 82. The position where the clamping operation is perfected is a position shown by the two-dotted chain line in FIG. 26. Then, the piston rod 137 moves further forward from this position, so that the fire hose 82 is fed to a position beyond the capstan 121. During this time, the rail support 129 is urged by the spring 157 to move reversely to the feeding direction. That is to say, the rail support 129 is designed so that the clamping force of the link plates 155*a* and 155*b* is not weakened by limitation of the rotation of the link plate actuating plate 151 caused by the excessive forward movement of the rail support 129 in the direction of the feeding direction of the fire hose 82. When the metal connectors 84 and 86 of the fire hose 82 is perfectly fed to the position beyond the capstan 121 as described above, the first air cylinder 123 operates reversely to move the piston rod 137 backward. At this time, the rail support 129 is returned to its original position by the elastic force of the spring 157 as the piston rod 137 moves backward. Consequently, the operation for releasing the clamping of the fire hose 82 by the link plates 155*a* and 155*b* can be carried out smoothly and securely.

When the backward moving operation of the piston rod 137 of the cylinder 135 is finished, the supporting arm driving motor not shown rotates reversely to press the pinch roller 122 to the clamping position of the fire hose 82 to thereby clamp the fire hose 82 between the pinch roller 122 and the capstan 121. Then, the fire hose 82 is fed by the operation of the capstan driving motor, so that washing work is carried out in the washing portion as feeding work of the fire hose 82 is carried out.

As described above, according to the sixth embodiment, the operation of avoiding the metal connectors 84 and 86 can be carried out securely by a simple mechanism using the first air cylinder 123, the link plate actuating plate 151 and the link plates 155*a* and 155*b* in combination and further using the cam slots 153 and 154.

Figure 28:
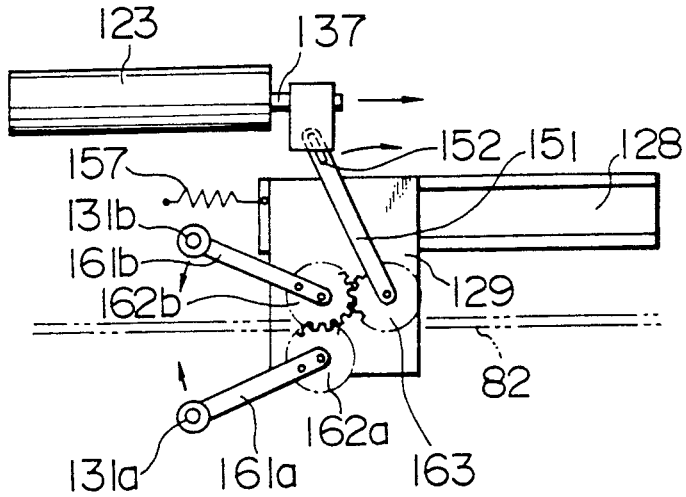
FIG. 28 is a front view showing the schematic configuration of a fire hose feeding portion as a seventh embodiment of the invention.
Figure 29:
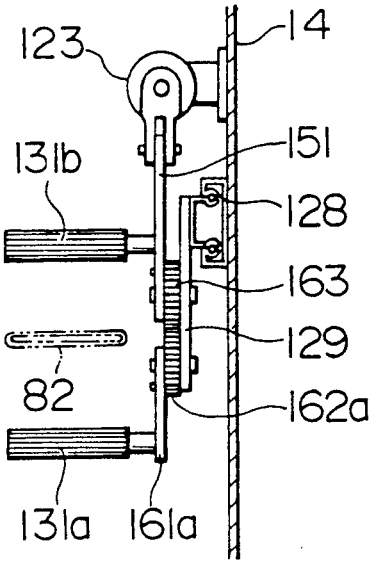
FIG. 29 is a right side view of the fire hose feeding portion of FIG. 28.
Figure 30:
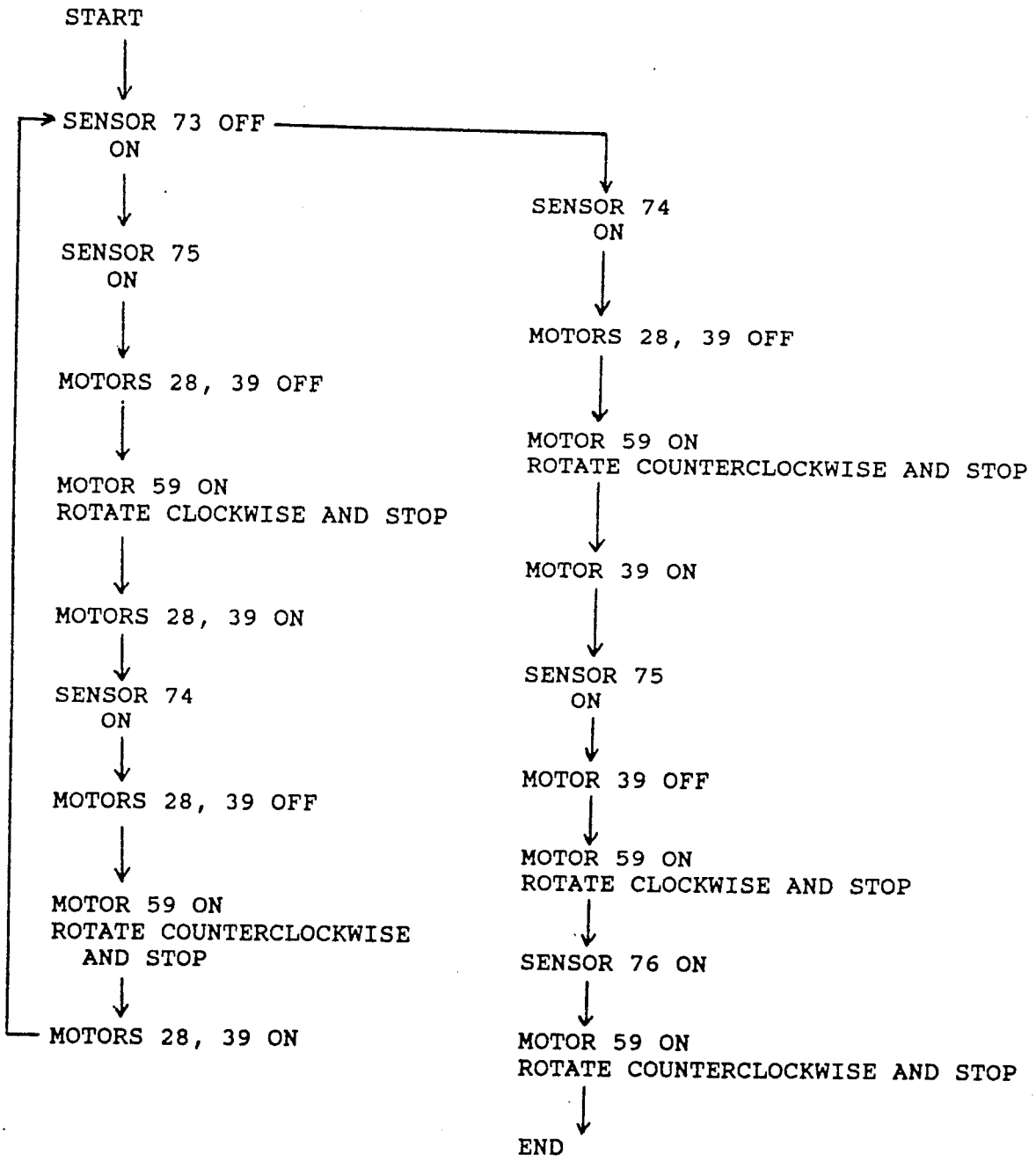
FIG. 30 is a flow chart for operating the first embodiment of the fire hose washing apparatus.

FIGS. 28 and 29 show a seventh embodiment of the invention in which the hose clamping and feeding mechanism is composed of an air cylinder, a rail support, and a pair of link plates using gears.

In the seventh embodiment, end surfaces of spur gears 162*a* and 162*b* are integrally fixed to base ends of a pair of link plates 161*a* and 161*b*, respectively. Each of the gears 162*a* and 162*b* has a center of rotation in each of the base ends of the link plates 161*a* and 161*b*. The gears 162*a* and 162*b* engaged with each other are rotatably mounted on the rail support 129. Another spur gear 163 is integrally fixed to a base end of the link plate actuating plate 151. The spur gear 163 is rotatably mounted on the rail support 129 so as to be rotated by engagement with the spur gear 162*b*. FIG. 28 is a schematic view showing the condition in which the fire hose 82 is fed normally as shown by the solid line in FIG. 26. When the cylinder 123 is in a position where the piston rod 137 is moved back, the link plates 161*a* and 161*b* are in a clamping released state where the fire hose 82 is not clamped. When the first air cylinder 123 operates to move the piston rod 137 forward in this condition, the link plate actuating plate 151 rotates clockwise. With the rotation of the link plate actuating plate 151, the spur gear 162*b* engaged with the spur gear 163 rotates. With the rotation of the spur gear 162*b*, the link plate 161*b* rotates counterclockwise. At the same time, the spur gear 162*a* engaged with the spur gear 162*b* rotates clockwise. With the rotation of the spur gear 162*a*, the link plate 161*a* rotates clockwise. When the clamping portions 131*a* and 131*b* at the ends of the link plates 162*a* and 162*b* approach each other to clamp the fire hose 82, the rotation of the link plates 162*a* and 162*b* is stopped and, accordingly, the rotation of the link plate actuating plate 151 is suppressed. Thus, the clamping operation of the fire hose 82 is perfected. When the first air cylinder 123 makes the piston rod 137 move further forward, the rail support 129 slides along the rails 128 in the direction shown in the drawing while the fire hose 82 is clamped. Consequently, the fire hose 82 is fed. Also in this embodiment, when the metal connectors 84 . . . 87 pass over the capstan 121 (Refer to FIG. 26), the first air cylinder 123 operates in the reverse direction to release the clamping of the fire hose 82 by the link plates 161*a* and 161*b* and, further, return the rail support 129 to the initial position for standing by the next operation.

As described above, according to the seventh embodiment, the operation of avoiding the metal connectors 84 . . . 87 can be carried out securely by such a simple mechanism using the first air cylinder 123, the link plate actuating plate 151 and the link plates 161*a* and 161*b* in combination and further using the spur gears 162*a*, 162*b* and 163.

While the invention has been described with respect to its preferred embodiments, it is to be understood that the words which have been used are words of description rather than limitation and that various changes may be made according to the invention without departing from the spirit or scope of the appended claims.

What is claimed is:

1. A fire hose washing apparatus comprising: a casing having a path for feeding a fire hose; fire hose washing means provided in said casing and along the path for feeding the fire hose; washing water supply means for supplying washing water to said washing means; first and second fire hose feeding means disposed separately from each other at a predetermined distance, said first and second fire hose feeding means being located at said fire hose feeding path in a downstream side of said washing means with respect to a direction of feeding of said fire hose; at least one metal connector detecting means for detecting metal connectors of said fire hose at said fire hose feeding path so that said first and second fire hose feeding means are alternately operated in accordance with the result of detection of said metal connector detecting means.

2. A fire hose washing apparatus according to claim 1, in which said fire hose washing means is constituted by pairs of rotary brushes disposed at intervals in said hose feeding direction, the rotary brushes in each pair being disposed at a upper and lower sides of the path respectively.

3. A fire hose washing apparatus according to claim 2, in which said pairs of rotary brushes are driven by a motor so that the rotary brushes in each pair disposed at the upper and lower sides respectively rotate in the opposite directions relative to each other.

4. A fire hose washing apparatus according to claim 1, in which each of said first and second fire hose feeding means is constituted by a capstan and a pinch roller movable relative to said capstan.

5. A fire hose washing apparatus according to claim 4, in which the respective capstans of said first and second fire hose feeding means are rotated by one motor.

6. A fire hose washing apparatus according to claim 4, in which said first and second fire hose feeding means further include supporting members for rotationally supporting the pinch rollers, rotary shafts, and a motor, said supporting members being respectively mounted on said rotary shafts so that when one pinch roller is in contact with the corresponding capstan, the other pinch roller is not in contact with the corresponding capstan, said two rotary shafts being actuated by the motor capable of rotating forward and reversely.

7. A fire hose washing apparatus according to claim 6, in which each of said supporting members supports the corresponding pinch roller so as to place the corresponding pinch roller in the upstream side in said hose feeding direction when the corresponding pinch roller is not in contact with the corresponding capstan.

8. A fire hose washing apparatus according to claim 7, in which each of said supporting members supports the corresponding pinch roller so as to place the pinch roller in the downstream side in said hose feeding direction when the corresponding pinch roller is not in contact with the corresponding capstan.

9. A fire hose washing apparatus according to claim 1, in which one of said first and second fire hose feeding means disposed at on upstream side with respect to said hose feeding direction is constituted by a capstan and a pinch roller movable relative to said capstan, and the other of said first and second fire hose feeding means disposed at a downstream side with respect to said hose feeding direction is constituted by hose clamping means having a pair of link levers for clamping and feeding said fire hose by means of a driving source.

10. A fire hose washing apparatus according to claim 9, in which said hose clamping means has a guide member for moving said hose clamping means in said hose feeding direction, and a slide member movably mounted on said guide member, said link levers being mounted on said slide member.

11. A fire hose washing apparatus according to claim 1, in which said metal connector detecting means is constituted by a first metal detecting device and a second metal detecting device, said first metal detecting device being placed at the downstream side of said fire hose washing means with respect to said hose feeding direction and between said fire hose washing means and one of said first and second fire hose feeding means near said fire hose washing means, and said second metal detecting device being placed between said first and second fire hose feeding means.

12. A fire hose washing apparatus according to claim 11, in which each of said first and second metal detecting devices includes an image sensor for detecting the metal connector of said fire hose as an image.

13. A fire hose washing apparatus according to claim 11, in which said second metal detecting device includes a detection member capable of being rotated by contact with the metal connector of said fire hose, and a switch operated by rotation of said detection member.

* * * * *